US012590700B2

(12) United States Patent
Andersen et al.

(10) Patent No.: US 12,590,700 B2
(45) Date of Patent: Mar. 31, 2026

(54) PLATE-FORMED GRATE ELEMENT FOR A MOVABLE GRATE OF A FURNACE

(71) Applicant: KANADEVIA INOVA DENMARK A/S, Holsted (DK)

(72) Inventors: Hans Bogh Andersen, Esbjerg O (DK); Morten Ryge Bogild, Esbjerg O (DK); Thomas Schaldemose Norman, Esberg O (DK)

(73) Assignee: KANADEVIA INOVA DENMARK A/S, Holsted (DK)

( * ) Notice: Subject to any disclaimer, the term of this patent is extended or adjusted under 35 U.S.C. 154(b) by 364 days.

(21) Appl. No.: 18/270,739

(22) PCT Filed: Dec. 16, 2021

(86) PCT No.: PCT/EP2021/086204
§ 371 (c)(1),
(2) Date: Jul. 3, 2023

(87) PCT Pub. No.: WO2022/148633
PCT Pub. Date: Jul. 14, 2022

(65) Prior Publication Data

US 2024/0125471 A1 Apr. 18, 2024

(30) Foreign Application Priority Data

Jan. 8, 2021 (EP) ..... 21150713

(51) Int. Cl.
*F23H 3/02* (2006.01)
*F23H 7/16* (2006.01)

(52) U.S. Cl.
CPC ..... *F23H 3/02* (2013.01); *F23H 7/16* (2013.01)

(58) Field of Classification Search
CPC ..... F27D 15/022
See application file for complete search history.

(56) References Cited

U.S. PATENT DOCUMENTS 4,091,750 A 5/1978 Theisler et al.
4,275,706 A 6/1981 Pauli
(Continued)

FOREIGN PATENT DOCUMENTS

CN 201014930 Y 1/2008
CN 201177455 Y 1/2009
(Continued)

OTHER PUBLICATIONS

International search report of Application No. PCT/EP2021/086204 Dated Mar. 7, 2022.

*Primary Examiner* — Ko-Wei Lin
(74) *Attorney, Agent, or Firm* — Oliff PLC

(57) ABSTRACT

The plate-formed grate element (1, 2) has a top wall (12), a bottom wall (13), a front end (14) and a back end (15). The front end has a lower inwardly curved wall portion (16) adapted to maintain a predetermined clearance with a back tip edge of a corresponding grate element. An internal cooling fluid chamber (18) includes an internal front cooling fluid channel (19) extending along the front end (14) of the grate element. The grate element has an outwardly curved front wall (22) having a nominal wall thickness varying by less than ±35 percent and extending from the top wall of the grate element to the lower inwardly curved wall portion of the front end, and a front tip edge (23) of the front end is formed by the outwardly curved front wall at its connection with the lower inwardly curved wall portion.

18 Claims, 21 Drawing Sheets

(56) References Cited

U.S. PATENT DOCUMENTS

| | | | | |
|---|---|---|---|---|
| 5,033,396 | A | 7/1991 | Pauli | |
| 5,617,801 | A * | 4/1997 | Hauser | F23H 7/08 110/282 |
| 5,913,274 | A * | 6/1999 | Kunzli | F23H 3/02 110/291 |
| 2006/0011114 | A1 * | 1/2006 | Esser | F23H 3/02 110/298 |

FOREIGN PATENT DOCUMENTS

| | | | |
|---|---|---|---|
| DE | 3343024 | A1 | 6/1985 |
| EP | 1092114 | A1 | 4/2001 |
| EP | 3482129 | A1 | 5/2019 |

* cited by examiner

PLATE-FORMED GRATE ELEMENT FOR A MOVABLE GRATE OF A FURNACE

CROSS REFERENCE TO RELATED APPLICATIONS

This is a 371 of PCT Application No. PCT/EP2021/086204, filed Dec. 16, 2021, which claims the benefit of European Application No. 21150713.2, filed Jan. 8, 2021, the contents of which are incorporated herein in their entirety.

The present invention relates to a plate-formed grate element for a movable grate of a furnace, the movable grate including a number of pivotal grate shafts carrying plate-formed grate elements and thereby defining an inclined grate surface, the movable grate including a drive mechanism being arranged for pivoting back and forth neighbouring grate shafts in opposite rotational directions so as to impart a wave-like movement to material on the grate surface in order to transport such material downwards, and the movable grate including a synchronising mechanism being arranged to maintain a predetermined clearance between edge portions of plate-formed grate elements of neighbouring grate shafts during the pivoting movement of the grate shafts, the plate-formed grate element having a top wall, a bottom wall, a front end and a back end, the front end of the plate-formed grate element having a lower inwardly curved wall portion being adapted to maintain said predetermined clearance with a back tip edge of the back end of a corresponding plate-formed grate element during part of said pivoting movement of the grate shafts when said plate-formed grate elements are arranged on neighbouring grate shafts, and the plate-formed grate element being provided with an internal cooling fluid chamber including an internal front cooling fluid channel having an inlet end and an outlet end and extending along the front end of the plate-formed grate element and above at least a part of the lower inwardly curved wall portion of the front end.

WO96/29544 discloses a combustion grate consisting of a plurality of zones that are arranged horizontally or at an angle. Each individual grate zone consists of fixed and movable grate sections with fixed fire bars and movable fire bars. The movable sections are moved forward and backward with a variable number of strokes, causing the fuel to be transported and consumed. The movable and fixed fire bars may be internally air/water-cooled. A fire bar with grate surface has a partition in its interior so that, looking in the lengthwise direction, a first cooling chamber and a second cooling chamber parallel thereto result. At the forward end of the fire bar, there is a water through-flow opening. This opening constitutes the link between the two cooling chambers. In each of these cooling chambers, there is a corrugated guide panel mounted parallel to the partition, said panel improving the heat exchange.

WO 99/63270 and WO 2018/007854 A1 disclose water-cooled movable grates for a combustion furnace. The movable grate includes a number of pivotal grate shafts carrying plate-formed grate elements, neighbouring grate shafts being arranged for pivoting back and forth in opposite rotational directions so as to maintain a predetermined clearance between edge portions of the plate-formed grate elements of the neighbouring grate shafts. The plate-formed grate elements have a front end with a relatively pointed front tip edge and a back end with a relatively pointed back tip edge. Each plate-formed grate element has a top wall and a bottom wall extending generally in parallel and in a spaced configuration, and the top wall and the bottom wall are connected at the front end of the plate-formed grate element by means of a straight front wall. The straight front wall forms an oblique angle with the top wall and extends from the top wall to a position of the pointed front tip edge which is below or at level with the bottom wall. At the pointed front tip edge, the straight front wall is connected with the bottom wall by means of a lower inwardly curved wall portion adapted to form said predetermined clearance with a back end of another plate-formed grate element. During operation, the front end of a plurality of plate-formed grate elements overlaps a corresponding back end of a plate-formed grate element of a neighbouring grate shaft. The predetermined clearance between the individual plate-formed grate elements, on which material intended for combustion is placed, provides for supplying primary air for the combustion. To make the supply of primary air as uniform as possible, it is important that the size of said predetermined clearance does not change when the plate-formed grate elements pivot in relation to each other or due to wear. Wear is caused by abrasive wear by the material which is burnt, this wear being further increased if the surface temperature of a plate-formed grate element is approaching the point of softening of the grate material because of the combustion heat. Therefore, at least some of the plate-formed grate elements include an internal cooling fluid chamber adapted for water cooling in order to reduce wear.

U.S. Pat. No. 4,275,706 relates to air-cooled grate bars, in particular for mechanically conveying mechanical grates such as pivot step grates. A cap of U-shape which is provided over the respective grate bar forms an air channel on top of the grate bar. Cooling air is injected into the channel through an inlet air tube extending downwards from a lower open side of the grate bar. The air exits from the channel at either end of the grate bar, whereby the air is guided through holes to the lower side of the grate bar. From there, the air flows up through gaps between neighbouring grate bars to the combustion chamber. As it is understood, the air channel on top of the grate bar therefore forms part of an open air cooling path and is not adapted for or suitable for fluid and/or liquid cooling in a cooling circuit, such as a closed loop circuit. At a back end of the grate bar, the grate bar is articulately mounted, and at this end, considered in side view, it has a lower curved section forming a bearing. At a front end of the grate bar, the grate bar is adapted to overlap a corresponding front end of another grate bar. However, in a modern combustion plant, at least a part of the grate bars typically need liquid cooling in order to withstand the harsh environment in the furnace. DE 33 43 024 A1 relates to similar air-cooled grate bars.

However, when burning some kinds of particularly aggressive fuel and/or high heat value fuel, such as fuel including predominantly shredded waste wood, the prior art plate-formed grate elements may suffer from excessive wear of the pointed front tip edge of the front end of the grate elements. In some cases, significant compressive stress may cause plastic deformation of the pointed front tip edge during operation. Subsequently, during cool down, the pointed front tip edge may experience high tensile stress due to the plastic deformation which may result in micro cracks in the front tip edge. Corrosion caused by high concentrations of heavy metals in the fuel may further aggravate the wear of the front tip edge.

In a combustion furnace of for instance a large waste incineration plant, the service life of the components of the movable grate is of utmost importance. Regular maintenance intervals of a combustion furnace may for instance be a year or so, and unexpected breakdown in between scheduled maintenance operations may seriously influence the economy of the plant.

The object of the present invention is to provide a plate-formed grate element being less prone to wear.

In view of this object, the plate-formed grate element has an outwardly curved front wall extending from the top wall of the plate-formed grate element to the lower inwardly curved wall portion of the front end, a front tip edge of the front end is formed by the outwardly curved front wall at its connection with the lower inwardly curved wall portion, and the outwardly curved front wall has a nominal wall thickness varying by less than ±35 percent.

In this way, it may be achieved that more cooling fluid flows closer to the front tip edge of the plate-formed grate element and the effect of the cooling fluid is evened out over the outwardly curved front wall, as compared to the prior art grate elements, thereby cooling the front tip edge better and more efficiently. A better cooling of the front tip edge may result in less wear of the front tip and therefore a longer service life of the plate-formed grate elements. Furthermore, a smooth curvature of the entire outwardly curved front wall may result in a stronger front wall without weak areas in which tension may build up.

In an embodiment, the nominal wall thickness of the outwardly curved front wall varies by less than ±30 percent, preferably less than ±25 percent, and most preferred less than ±20 percent. By reducing the variation of the nominal wall thickness of the outwardly curved front wall even further, it may be possible to further even out the effect of the cooling fluid over the outwardly curved front wall and thereby to a higher degree obtain even cooling of the front wall. In particular, it may be possible to avoid insufficient cooling of the front tip edge.

Preferably, the outwardly curved front wall has an at least substantially constant wall thickness.

In a structurally particularly advantageous embodiment, the part of the outwardly curved front wall extending from the top wall of the plate-formed grate element to the front tip edge has an outer contour with a first nominal radius of curvature (R) varying by less than ±40 percent, and preferably less than ±20 percent, the front tip edge has an outer contour with a second nominal radius of curvature (r) varying by less than ±20 percent, and the first nominal radius of curvature (R) is more than 2 times larger, preferably more than 3 times larger, more preferred more than 4 times larger and most preferred more than 5 times larger than the second nominal radius of curvature (r). Thereby, it may in particular be possible to concentrate the effect of the cooling fluid flowing closer to the front tip edge of the plate-formed grate element.

In an embodiment, the internal front cooling fluid channel is formed at least by the outwardly curved front wall, at least a part of the lower inwardly curved wall portion of the front end, and a front internal separating wall connecting the top wall and the bottom wall of the plate-formed grate element, and the front internal separating wall, at a central position of the front end, forms a restriction of a cross-sectional flow area of the internal front cooling fluid channel. Thereby, it may be possible to obtain a generally higher velocity of the cooling fluid close to the front tip edge of the plate-formed grate element, thereby improving the cooling effect at the front tip edge.

In an embodiment, the restriction of the cross-sectional flow area of the internal front cooling fluid channel is formed gradually from the inlet end to the outlet end of the internal front cooling fluid channel. Thereby, an even cooling effect may be obtained along the front end and in particular along the front tip edge of the plate-formed grate element.

Preferably, the restriction of the cross-sectional flow area of the internal front cooling fluid channel is formed in that the front internal separating wall is V-formed or curved in a longitudinal direction of the front internal separating wall.

In an embodiment, a reduced cross-sectional flow area at said restriction is less than 60 percent, preferably less than 50 percent, and most preferred less than 40 percent of an inlet/outlet cross-sectional flow area at the inlet and/or outlet end of the internal front cooling fluid channel. Thereby, an even cooling effect may be obtained along the front end and in particular along the front tip edge of the plate-formed grate element.

In an embodiment, an internal inlet guide vane is arranged in the internal cooling fluid chamber at the inlet end of the internal front cooling fluid channel, an internal outlet guide vane is arranged in the internal cooling fluid chamber at the outlet end of the internal front cooling fluid channel, and said internal inlet guide vane and said internal outlet guide vane are adapted to guide cooling fluid in the direction of respective corners of the internal cooling fluid chamber at respective ends of the front end of the plate-formed grate element. Thereby, more cooling fluid may be guided to the corners of the internal cooling fluid chamber and the cooling effect may be improved at the ends of the front end and in particular of the front tip edge of the plate-formed grate element.

In an embodiment, the internal inlet guide vane is connected to the top wall or the bottom wall of the plate-formed grate element and is spaced in relation to the top wall or bottom wall being opposed to the top wall or the bottom wall to which the internal inlet guide vane is connected, and the internal outlet guide vane is connected to the top wall or the bottom wall of the plate-formed grate element and is spaced in relation to the top wall or bottom wall being opposed to the top wall or the bottom wall to which the internal outlet guide vane is connected. Thereby, cooling fluid may be guided in the direction of the respective corners of the internal cooling fluid chamber without limiting the general flow of cooling fluid too much. Furthermore, the production of the plate-formed grate element by casting may be facilitated in that casting sand may better pass through the internal cooling fluid chamber of the plate-formed grate element.

In an embodiment, the internal inlet guide vane and the internal outlet guide vane are arranged at an oblique angle in relation to a longitudinal direction of the front end. Thereby, the cooling fluid may be guided to maximise the cooling effect at the ends of the front end and in particular of the front tip edge of the plate-formed grate element.

In an embodiment, a U-formed internal separating wall arranged in the internal cooling fluid chamber 18 is composed by an intermediate wall part in the form of the front internal separating wall and two internal side separating walls, the two internal side separating walls have respective free ends located at a distance from the back end of the plate formed grate element, and each of the internal inlet guide vane and the internal outlet guide vane are spaced in relation to the U-formed internal separating wall. Thereby, a sufficient amount of cooling fluid may be guided to the corners of the internal cooling fluid chamber and a sufficient amount of cooling fluid may be guided directly through the internal front cooling fluid channel, whereby a balanced cooling effect may be obtained both at the sides of the front end and in particular of the front tip edge of the plate-formed grate element. Furthermore, the production of the plate-formed grate element by casting may be even further facilitated in that casting sand may better pass through the internal cooling fluid chamber of the plate-formed grate element.

The present invention further relates to a furnace with a movable grate including a number of plate-formed grate elements as described above.

The invention will now be explained in more detail below by means of examples of embodiments with reference to the very schematic drawing, in which FIG. 1 is a longitudinal cross-section through a prior art plate-formed grate element for a movable grate of a furnace;

Figure 16A:
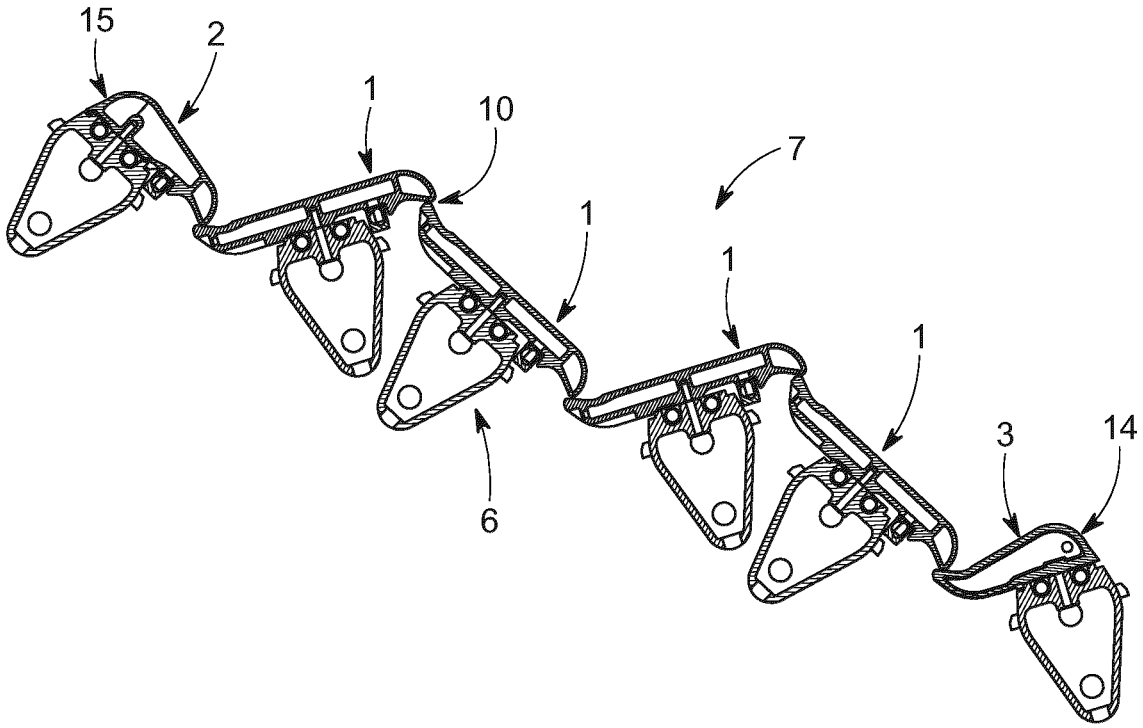
Figure 16B:
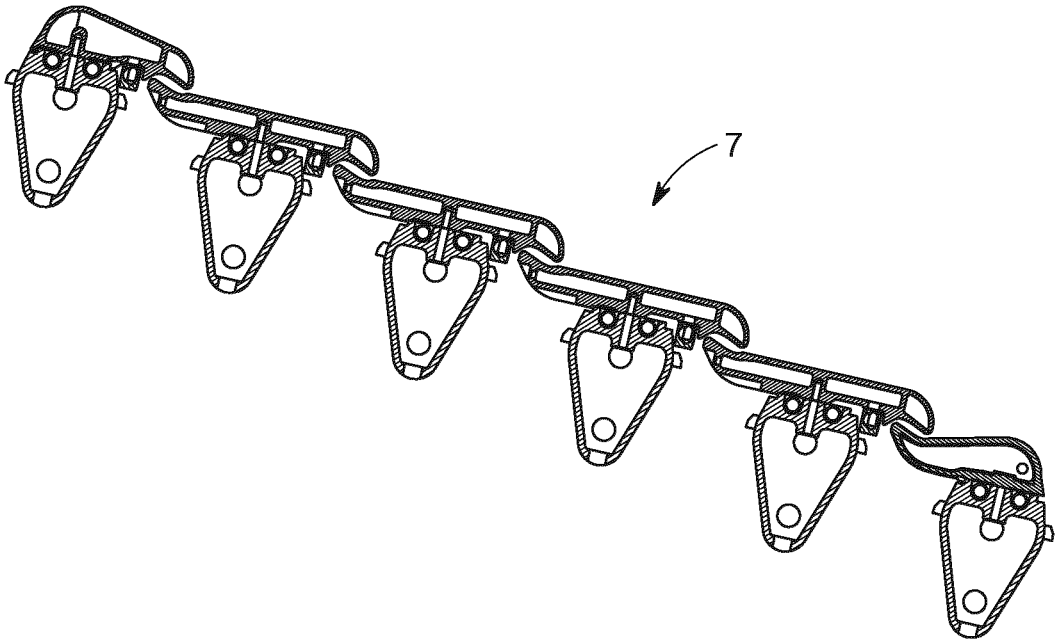
Figure 16C:
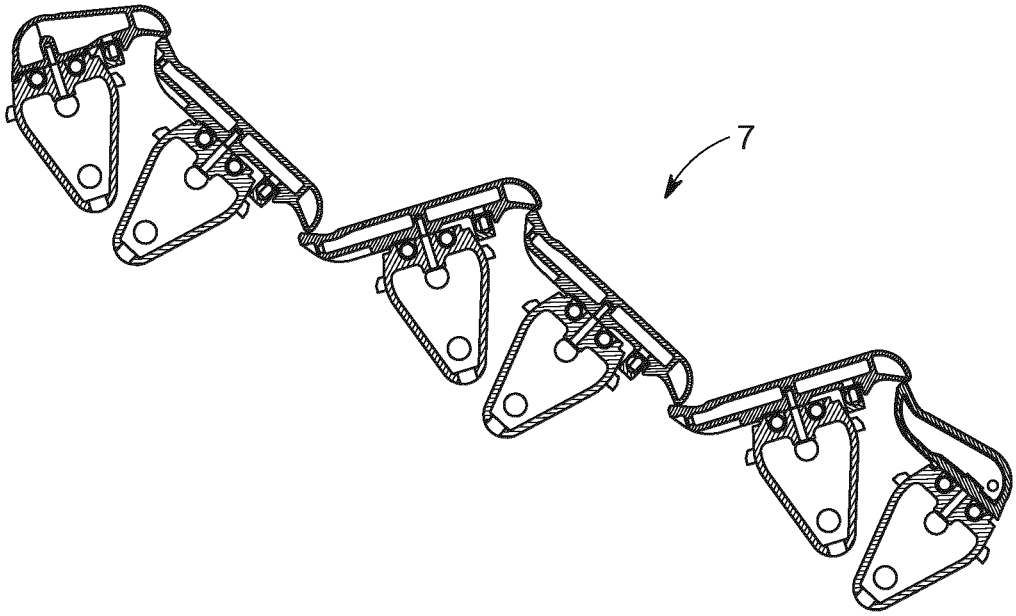
Figure 17:
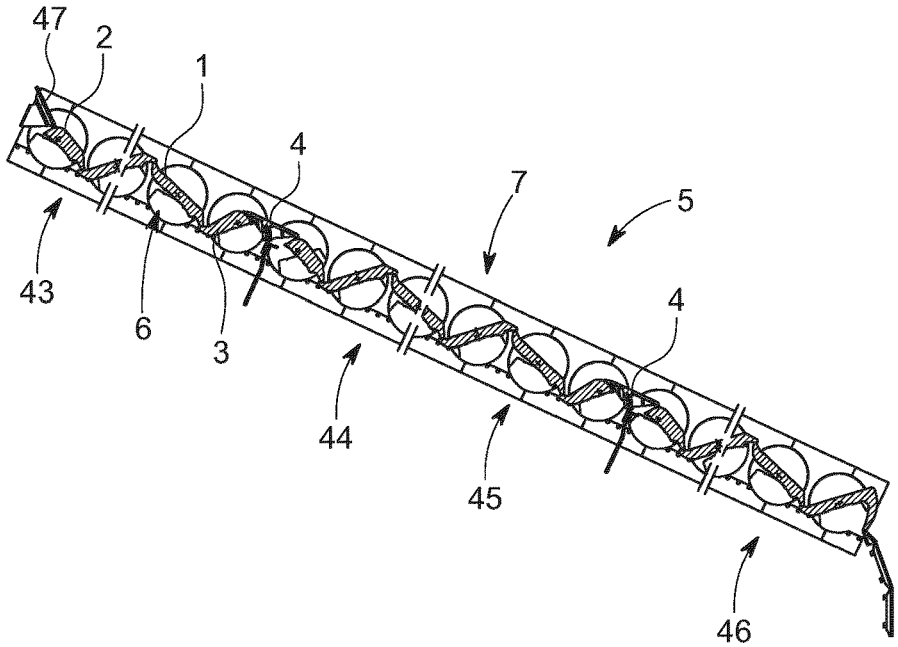
Figure 18:
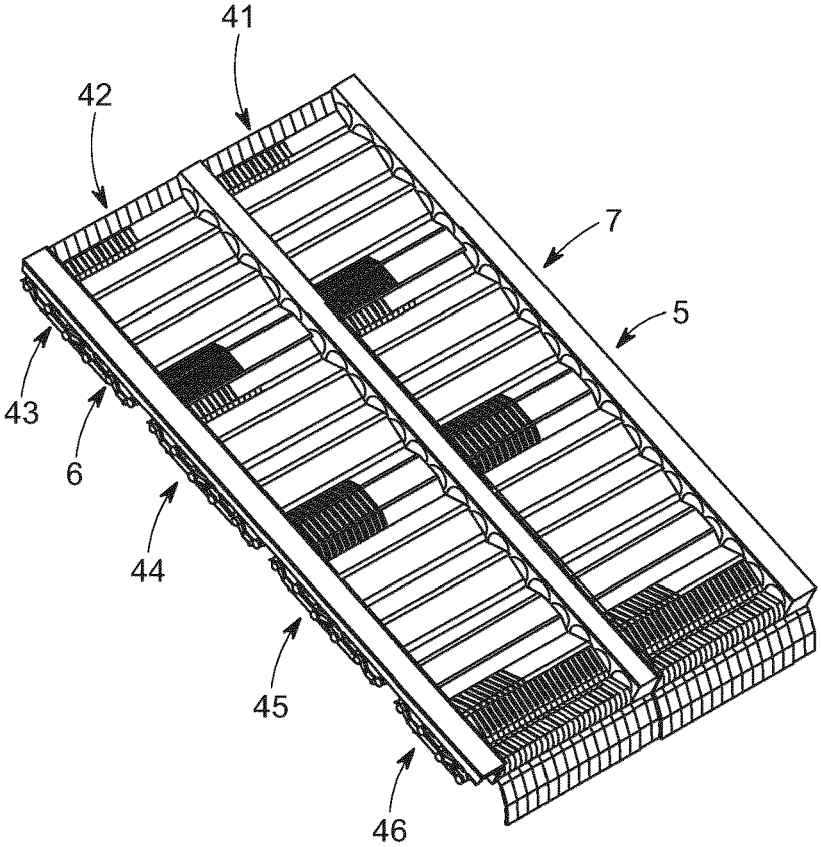
Figure 19:
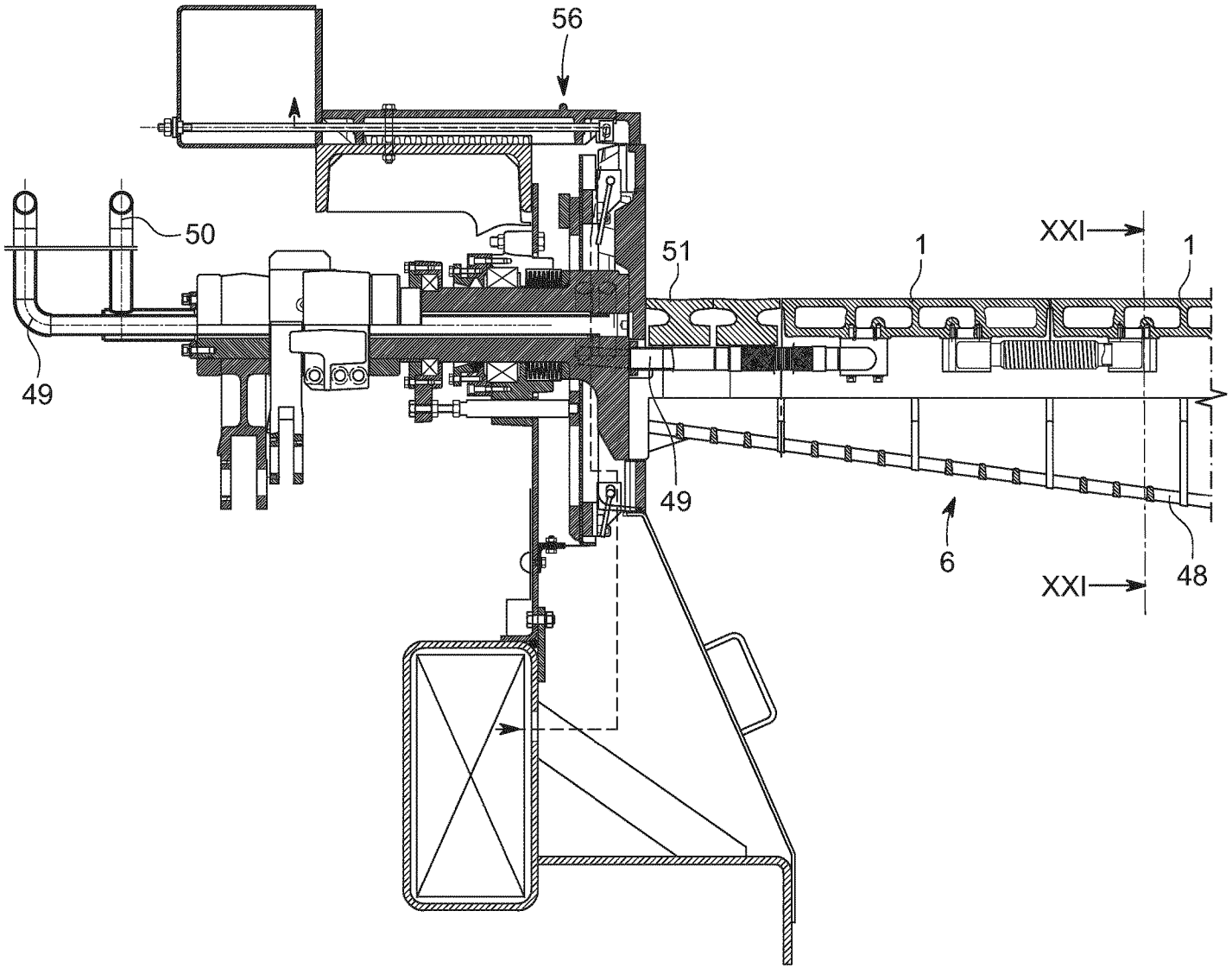
Figure 20:
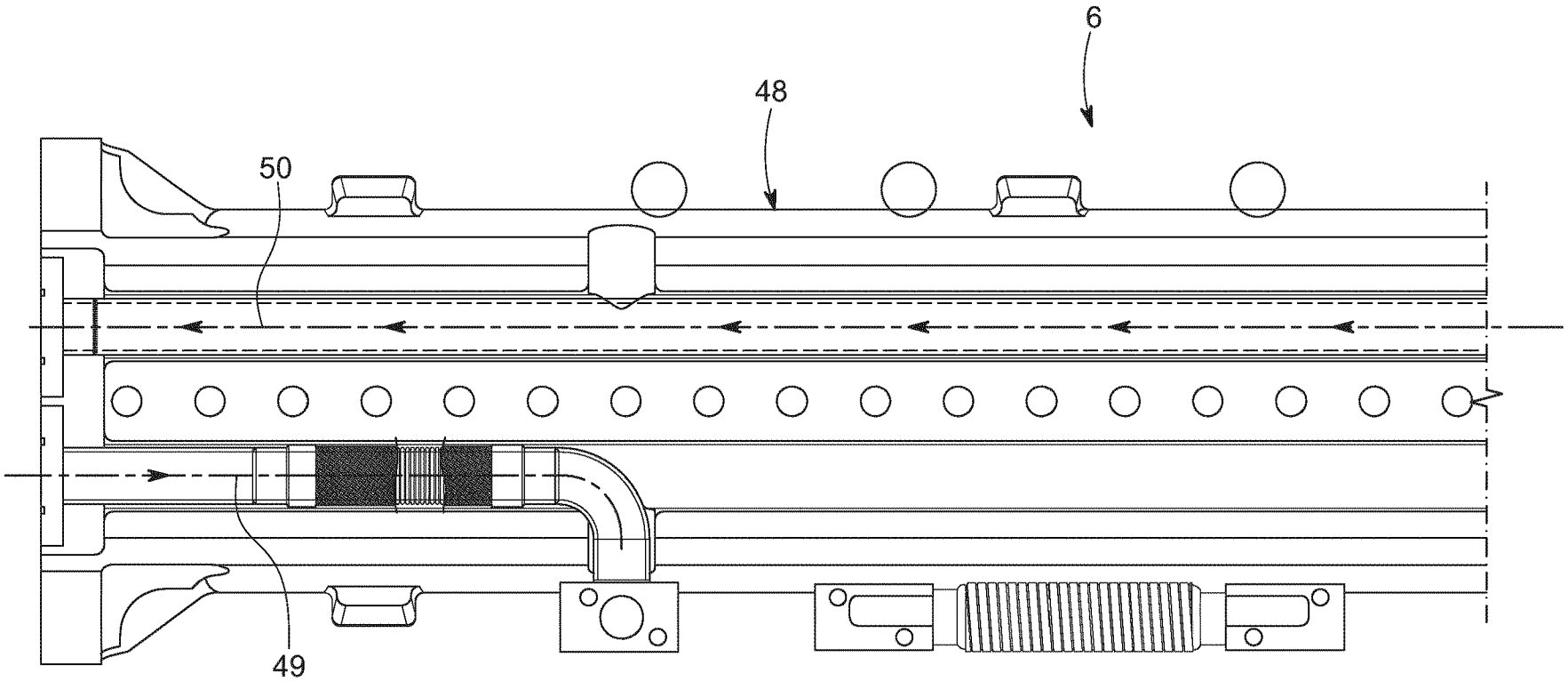
Figure 21:
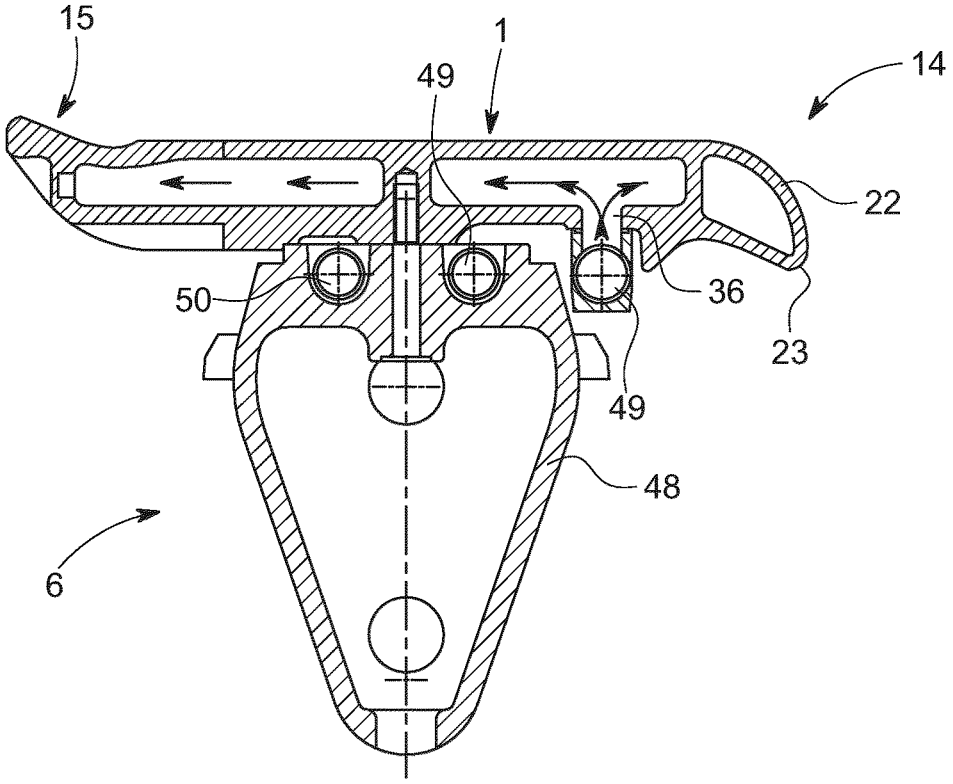
Figure 22:
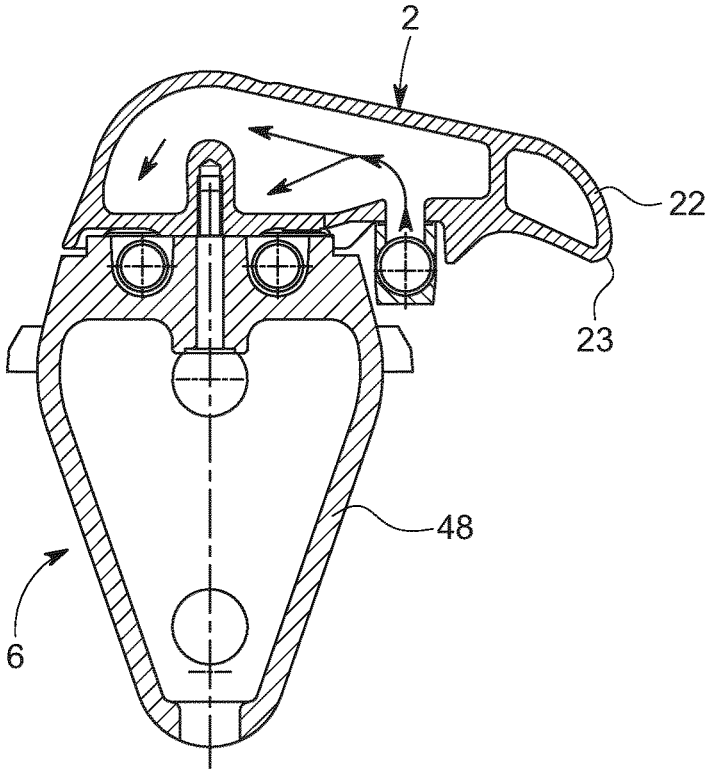
Figure 23:
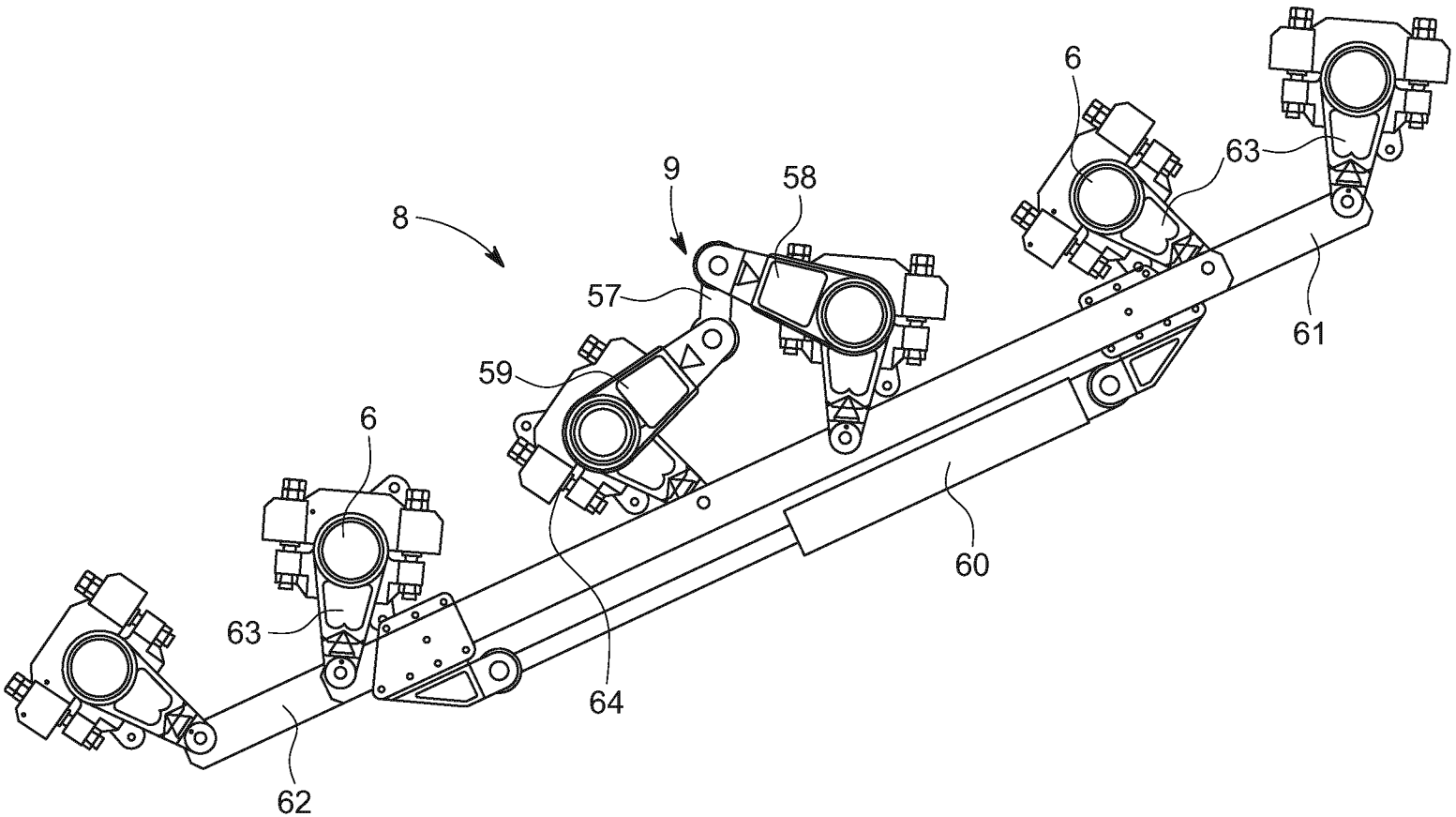
Figure 24:
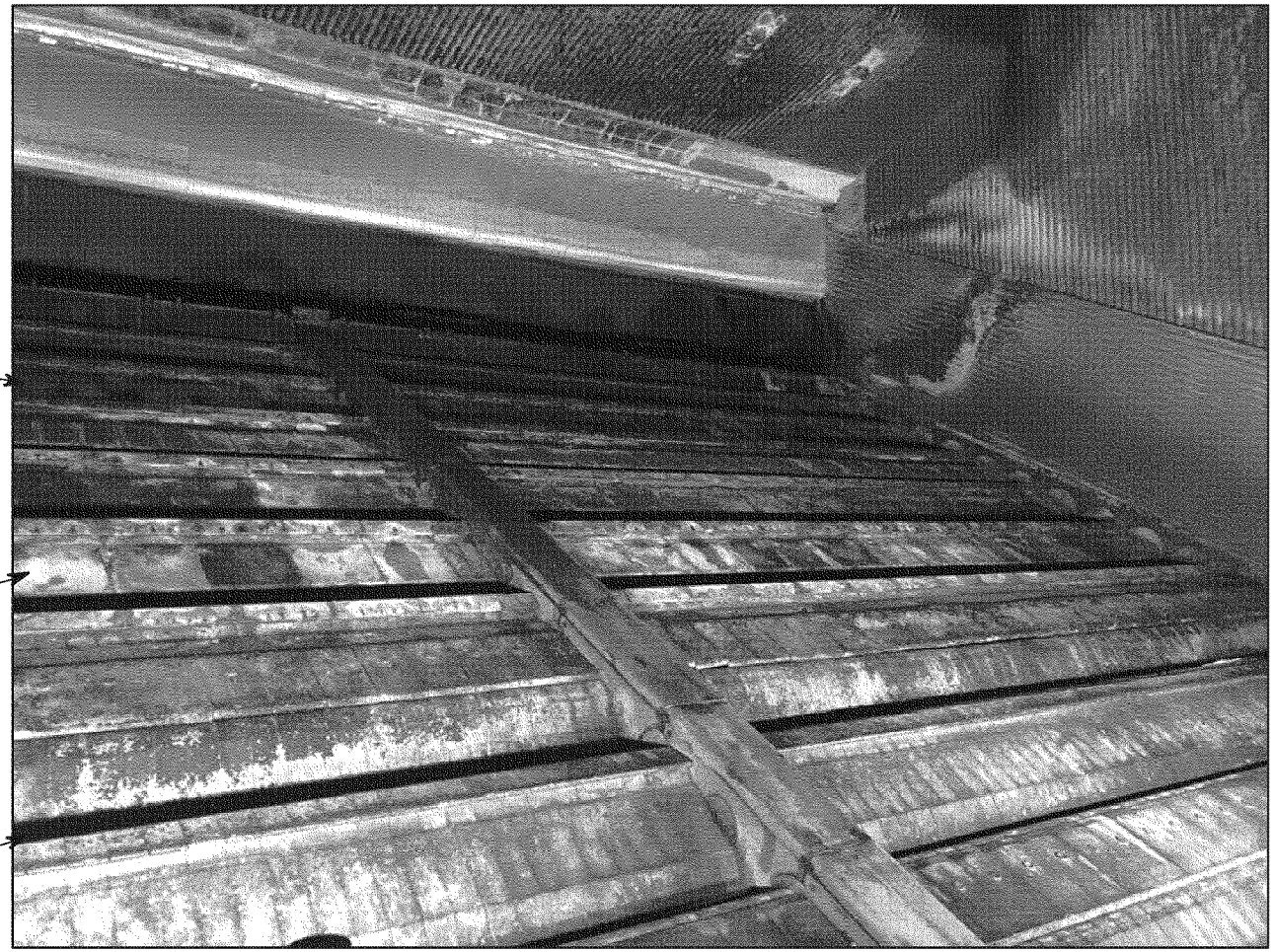
Figure 27:
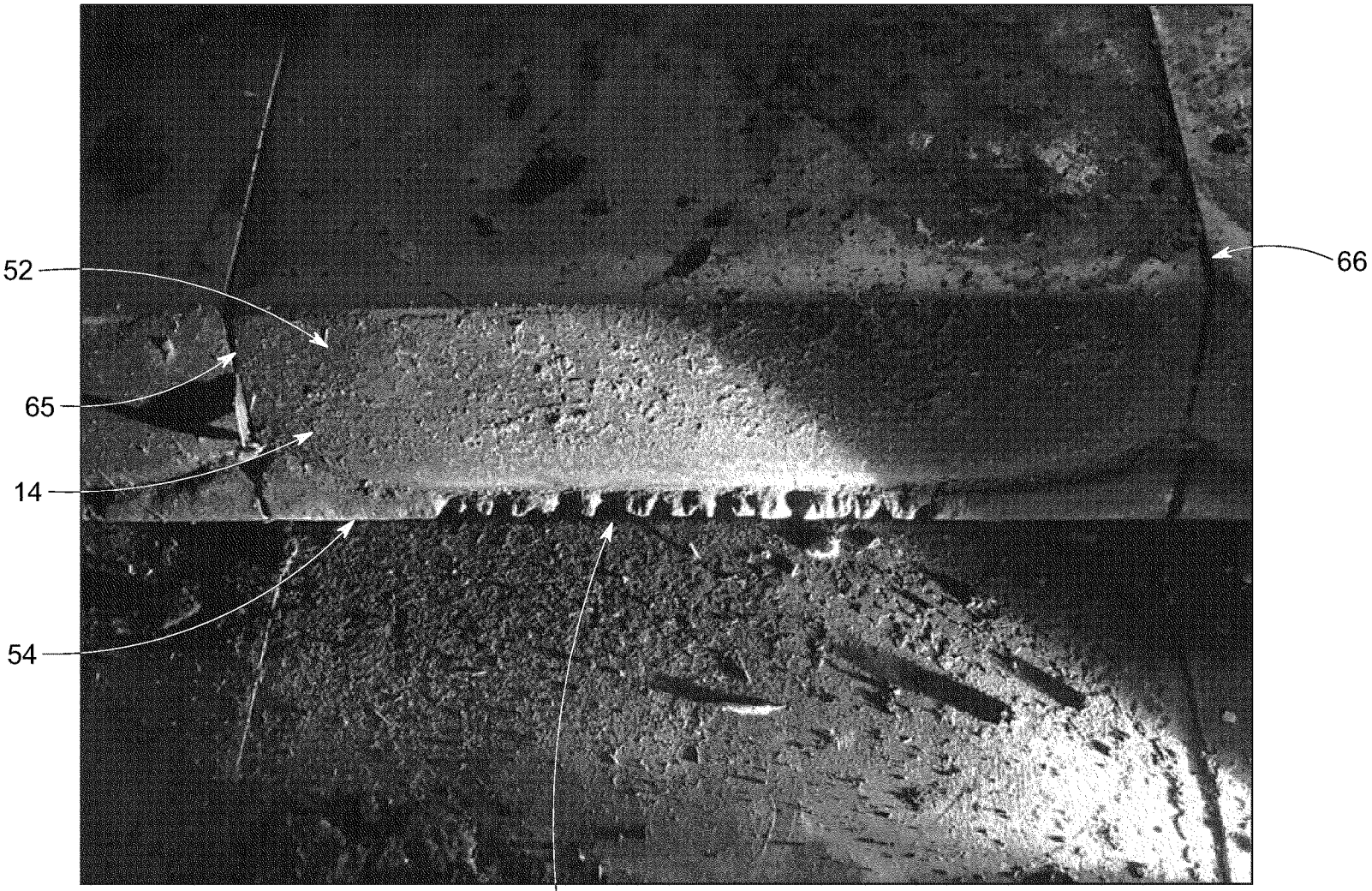
Figure 28:
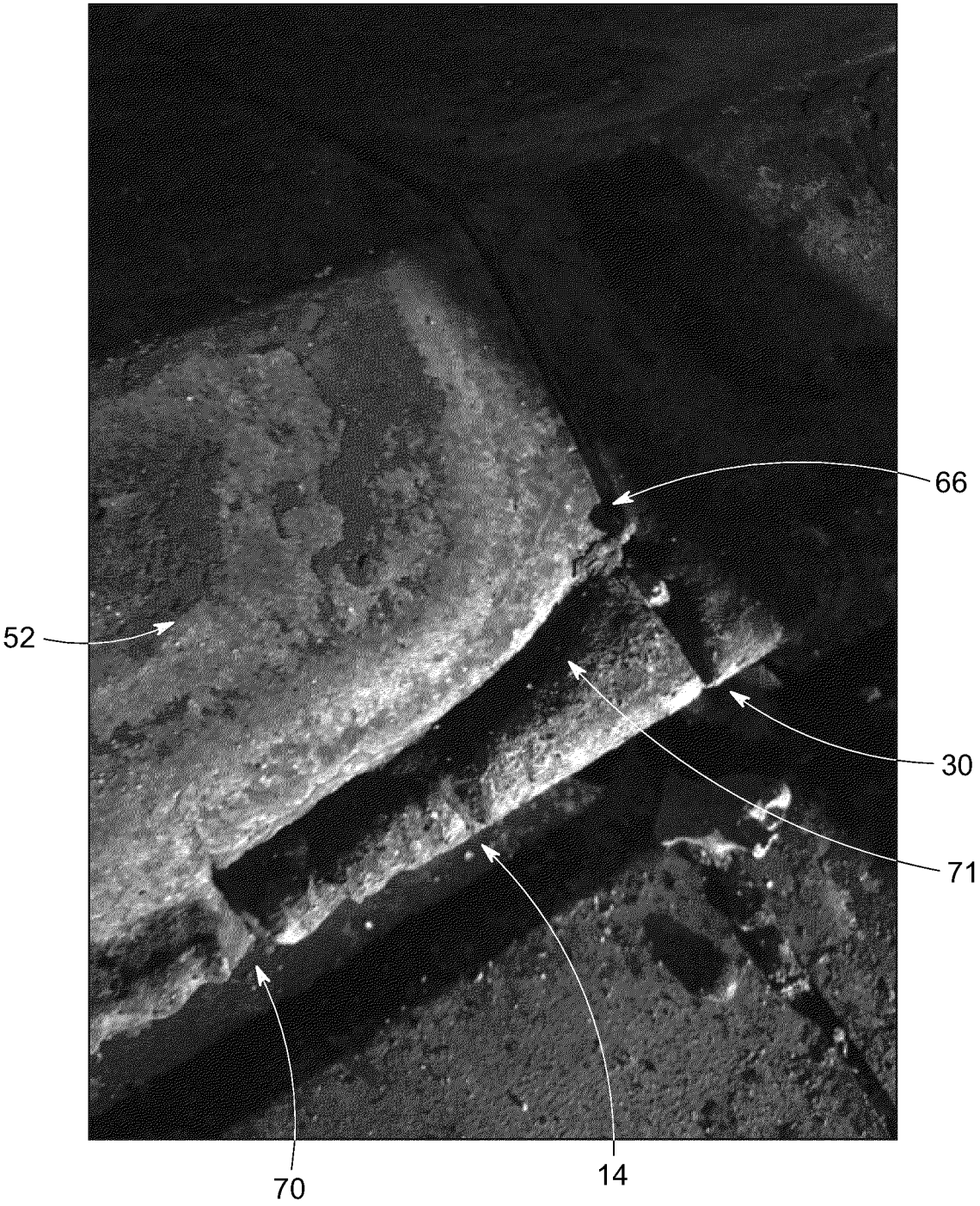
Figure 29:
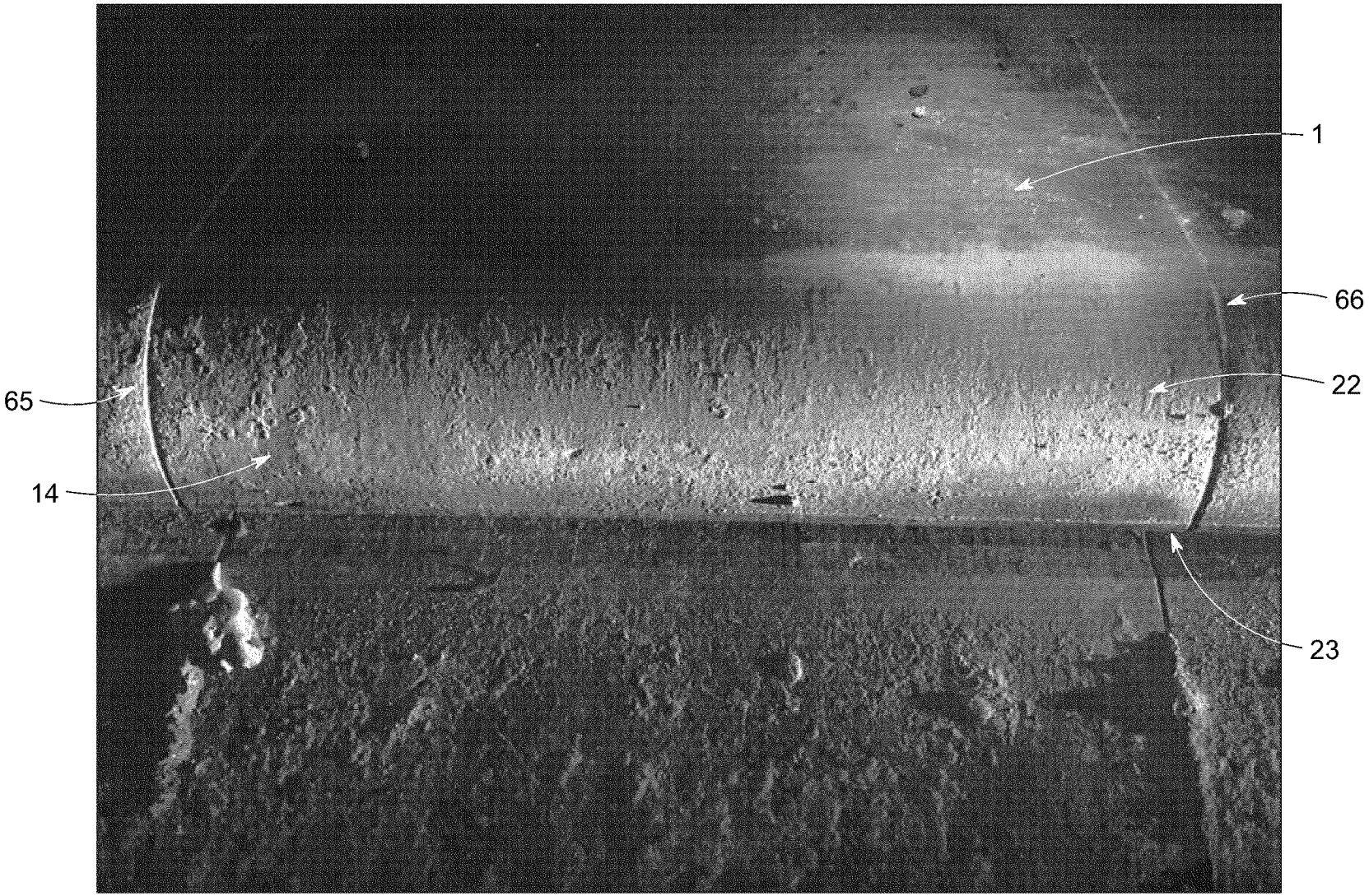
Figure 30:
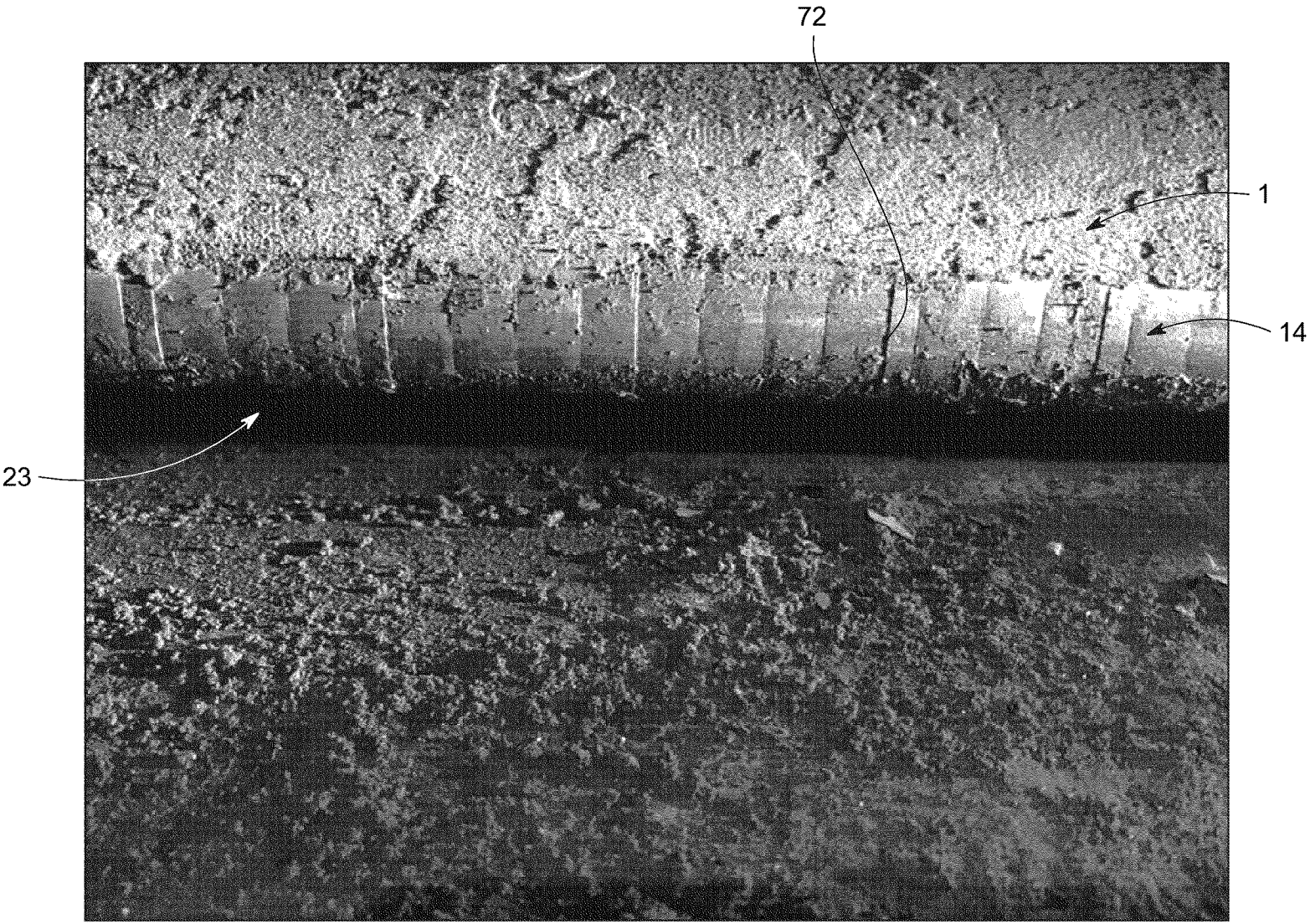

FIGS. 16A-C illustrate cross-sectional views of a section of a movable grate including a number of plate-formed grate elements according to the present invention, in different stages of operation;

FIG. 17 illustrates a longitudinal section through a movable grate including a number of plate-formed grate elements according to the present invention;

FIG. 18 illustrates a perspective view seen obliquely from above of the movable grate as illustrated in FIG. 17;

FIG. 19 illustrates a transverse section through part of the movable grate illustrated in FIG. 17;

FIG. 20 illustrates a top view of part of the movable grate as illustrated in FIG. 19;

FIG. 21 is a cross-section taken along the line XXI-XXI of the movable grate as illustrated in FIG. 19;

FIG. 22 is a cross-sectional view corresponding to that of FIG. 21, but illustrating a so-called half plate-formed grate element according to the present invention;

FIG. 23 illustrates a drive and synchronising mechanism being arranged for pivoting back and forth grate shafts of a section of the movable grate illustrated in FIG. 17;

FIG. 24 is a photograph showing a test facility in the form of a furnace having a movable grate;

FIGS. 25 to 28 are photographs of prior art plate-formed grate elements after a period of operation of approximately 6 months; and FIGS. 29 and 30 are photos of a plate-formed grate element according to the present invention after a period of operation of approximately 6 months.

In the following, generally, similar elements of different embodiments have been designated by the same reference numerals.

FIGS. 3 to 12 illustrate a full-sized plate-formed grate element 1, according to the present invention, for use in a movable grate 5 of a furnace of the type illustrated in FIGS. 17 and 18. As seen, the movable grate 5 includes a number of pivotal grate shafts 6 carrying plate-formed grate elements 1, 2, 3 and thereby defining an inclined grate surface 7. The pivotal grate shafts 6 are illustrated in further detail in FIGS. 16 and 19 to 22. Referring to FIG. 23, the movable grate 5 further includes a drive mechanism 8 being arranged for pivoting back and forth neighbouring grate shafts 6 in opposite rotational directions so as to impart a wave-like movement to material on the grate surface 7 in order to transport such material downwards. The drive mechanism 8 is arranged so that each grate shafts 6 is provided with a crank arm 63, the crank arms of every other grate shafts 6 are connected by means of a first linking rod 61 and the crank arms 63 of the remaining grate shafts 6 are connected by means of a second linking rod 62, the actuator of said drive mechanism is a linear actuator 60, such as a hydraulic piston actuator, and the first linking rod 61 and the second linking rod 62 are interconnected by means of the linear actuator 60. Instead of being provided on the grate shafts 6, the crank arms 63 may be mounted on separate shafts connected to the respective grate shafts 6 via separate crank systems or via any other suitable mechanical drive connection.

Referring still to FIG. 23, the movable grate 5 further includes a synchronising mechanism 9 being arranged to maintain a predetermined clearance 10 (so small that it is not distinguishable in the figures) between edge portions 11 of plate-formed grate elements 1, 2, 3 of neighbouring grate shafts 6 during the pivoting movement of the grate shafts 6. The synchronising mechanism 9 includes a first synchronising lever arm 58 having a first end fixedly connected to one of the grate shafts 6 connected to the first linking rod 61 and a second synchronising lever arm 59 having a first end fixedly connected to one of the grate shafts 6 connected to the second linking rod 62. The second ends of the respective first and second synchronising lever arms 58, 59 are pivotally connected to respective ends of a synchronising rod 57. Thereby, the synchronising mechanism 9 may maintain said predetermined clearance between edge portions of plate-formed grate elements 1, 2, 3 of neighbouring grate shafts 6.

By means of the drive mechanism 8 and the synchronising mechanism 9, the mutual relative pivotal positions of the respective grate shafts 6 of the movable grate 5 may be individually elastically biased towards respective predetermined relative pivotal positions by means of respective biasing mechanisms in the form of disc springs 64 arranged in respective mounting brackets of the crank arm 63 on the grate shafts 6. Thereby, if the movement of a grate shaft 6 is prevented, the movement may wholly or partly be taken up by the biasing mechanisms.

The plate-formed grate elements 1, 2, 3 on each grate shaft 6 coincide with the plate-formed grate elements 1, 2, 3 on the neighbouring shaft 6 without touching these, thereby forming the practically cohesive inclined grate surface 7. The gap between two coinciding plate-formed grate elements 1, 2, 3 in the form of the predetermined clearance mentioned just above may for instance be approximately 1 to 3 millimetres. The grate function is such that the grate shafts 6 alternately turn to their respective outer positions, as illustrated in FIGS. 16A and 16 C, respectively, thereby passing their intermediate position, as illustrated in FIG. 16B, and the inclined grate surface 7 thus forms a stair-shaped surface where the steps change direction. This produces a rolling movement to material present on the movable grate 5, which may have the effect of breaking it up and agitating it, while at the same time moving it forward in downward direction, thus achieving good exposure to radiant heat from the combustion chamber above the movable grate 5 and good exposure to combustion air. In particular, the access of primary combustion air through the gaps formed between edge portions 11 of plate-formed grate elements 1, 2, 3 of neighbouring grate shafts 6, from below the movable grate 5 to the combustion chamber above the movable grate 5, is controlled by the predetermined clearance 10 between neighbouring plate-formed grate elements 1, 2, 3.

FIG. 18 illustrates a complete movable grate 5 for a not shown furnace. The movable grate 5 has a left grate lane 41 and a right grate lane 42. However, the illustrated type of movable grate 5 may have any suitable number of grate lanes, such as one, two, three, four or even more grate lanes. FIG. 17 illustrates a longitudinal section through the right grate lane 42 of the movable grate 5 of FIG. 18. Each grate lane 41, 42 has a first section 43, on which the fuel enters, a second section 44, a third section 45, and a fourth section 46, from which the fuel finally exits. More sections may be provided. The first and second sections 43, 44 may typically include plate-formed grate elements 1, 2 provided with internal cooling fluid chambers 18 through which a cooling fluid, typically a liquid, such as water, is circulated. The third and fourth sections 45, 46 may typically be cooled by means of primary combustion air so that internal cooling fluid chambers 18 are not required in the plate-formed grate elements 1, 2 of these sections.

Figure 13:
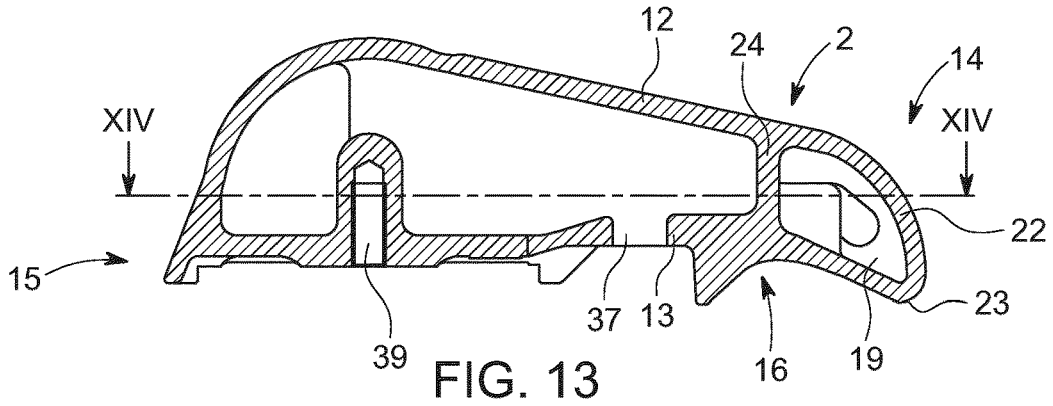
FIG. 13 is a longitudinal cross-section through a so-called first half plate-formed grate element according to the present invention, for a movable grate of a furnace.
Figure 14:
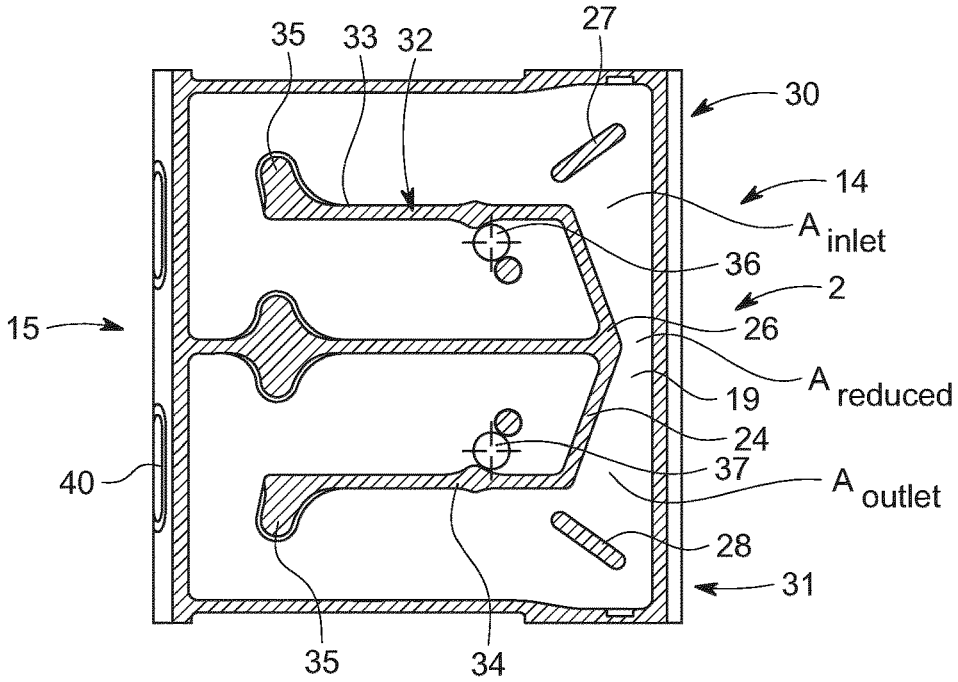
FIG. 14 is a cross-section taken along the line XIV-XIV of the first half plate-formed grate element as illustrated in FIG. 13.
Figure 15:
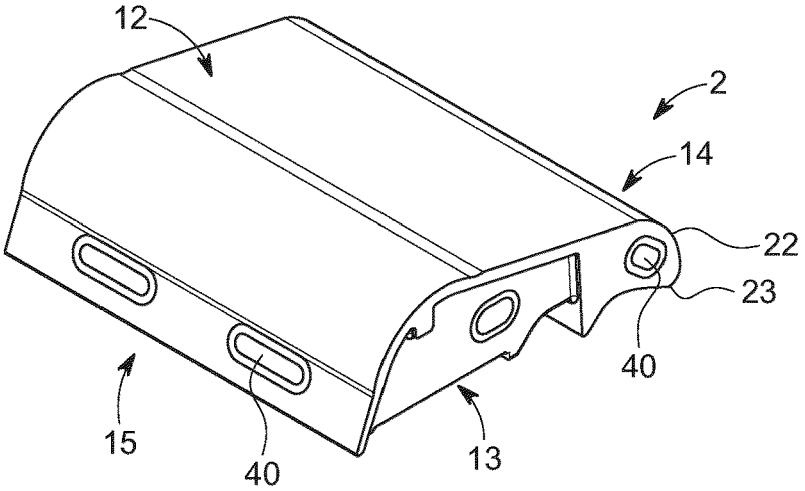
FIG. 15 is a perspective view seen obliquely from above of the first half plate-formed grate element according to the present invention as illustrated in FIG. 13.

FIGS. 16A, 16B and 16C illustrate different stages of operation of the first section 43 of the right grate lane 42 of the movable grate 5 illustrated in FIG. 18. It is noted that the first section 43 of the right grate lane 42 includes from left to right, a so-called first half plate-formed grate element 2, four full-sized plate-formed grate elements 1 arranged in succession and a so-called last half plate-formed grate element 3. In this connection, the designation "half" simply refers to a reduced length of the first and last plate-formed grate elements 2, 3, as compared to the full-sized plate-formed grate elements 1. In addition, it is seen that the first half plate-formed grate element 2 has a specific design of its back end 15 and the last half plate-formed grate element 3 has a specific design of its front end 14, as it will be explained in further detail in the following. Comparing with FIG. 17, it is noted that a back end 15 of the first half plate-formed grate element 2 cooperates with a stationary inlet connection plate 47. In order to do this, the back end 15 of the first half plate-formed grate element 2 is shorter and has a rounded contour as compared to the back end 15 of the full-sized plate-formed grate elements 1. The first half plate-formed grate element 2 according to the present invention is illustrated in FIGS. 13 to 15. Referring again to FIG. 16, it is noted that the front end 14 of the first half plate-formed grate element 2 cooperates with the back end 15 of the first one of the four full-sized plate-formed grate elements 1 in the same way as the front end 14 of each of the first, second and third full-sized plate-formed grate element 1 cooperates with the back end 15 of a neighbouring full-sized plate-formed grate element 1. Furthermore, it is noted that the front end 14 of the last (fourth) full-sized plate-formed grate element 1 cooperates with a back end 15 of the last half plate-formed grate element 3 in the same way as the front end 14 of a full-sized plate-formed grate element 1 cooperates with the back end 15 of a neighbouring full-sized plate-formed grate element 1. However, referring to FIG. 17, it is noted that a front end 14 of the last half plate-formed grate element 3 cooperates with a fixed plate-formed grate element 4 arranged between the first section 43 of the grate lane 42 and the second section 44 of the grate lane 42. In order to do this, the front end 14 of the last half plate-formed grate element 3 is shorter and has a different contour as compared to the front end 14 of the full-sized plate-formed grate elements 1.

Because the front end 14 of the last half plate-formed grate element 3 during operation is located below the fixed plate-formed grate element 4, the front end 14 of the last half plate-formed grate element 3 is subjected to lower temperatures than the front end 14 of the first half plate-formed grate element 2 and the front end 14 of each of the four full-sized plate-formed grate elements 1. Therefore, the requirement for cooling of the front end 14 of the last half plate-formed grate element 3 is relatively low and the last half plate-formed grate element 3 is therefore not necessarily provided with an internal cooling fluid chamber and is not designed according to the present invention.

However, the front end 14 of the first half plate-formed grate element 2 is during operation located above the back end 15 of the first one of the four full-sized plate-formed grate elements 1 in the same way as the front end 14 of each full-sized plate-formed grate element 1 is during operation located above the back end 15 of a neighbouring full-sized plate-formed grate element 1 or above the back end 15 of the last half plate-formed grate element 3. Therefore, the front end 14 of the first half plate-formed grate element 2 and the front end 14 of each full-sized plate-formed grate element 1 are subjected to extremely high temperatures caused by the combustion of fuel on the movable grate 5 during operation. Therefore, the requirement for cooling of the front end 14 of the first half plate-formed grate element 2 and the front end 14 of each full-sized plate-formed grate element 1 is very high in order to avoid excessive wear. An embodiment of the full-sized plate-formed grate element 1 according to the present invention is illustrated in FIGS. 3 to 12 and 21, and an embodiment of the first half plate-formed grate element 2 according to the present invention is illustrated in FIGS. 13 to 15 and 22. The plate-formed grate elements 1, 2 according to the present invention are less prone to wear of in particular the front tip edge 23, as it will be explained in further detail below.

Figure 4:
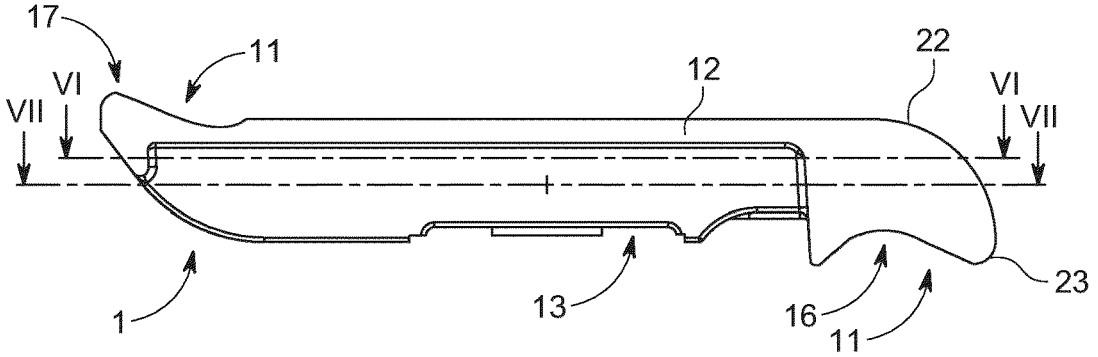
FIG. 4 is a side view of the plate-formed grate element of FIG. 3.
Figure 5:
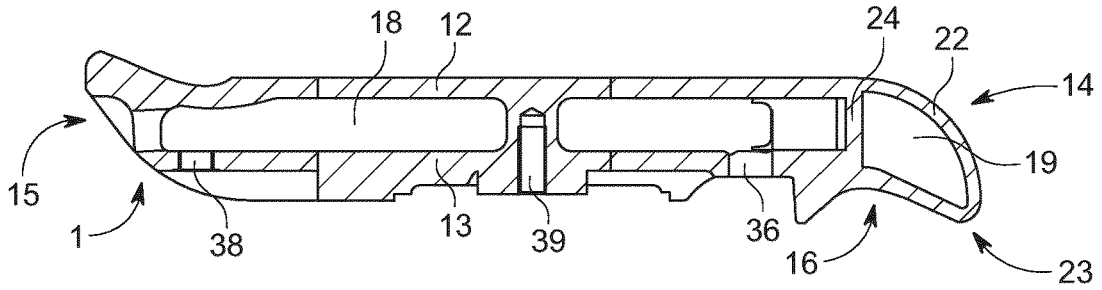
FIG. 5 is a cross-section taken along the line V-V of the plate-formed grate element as illustrated in FIG. 3.

Referring to FIGS. 4 and 5, the plate-formed grate element 1 according to the present invention has a top wall 12, a bottom wall 13, a front end 14 and a back end 15. The front end 14 of the plate-formed grate element 1 has a lower inwardly curved wall portion 16 being adapted to maintain said predetermined clearance 10 with a back tip edge 17 of the back end 15 of a corresponding plate-formed grate element 1 during part of said pivoting movement of the grate shafts 6 when said plate-formed grate elements 1 are arranged on neighbouring grate shafts 6. The pivoting movement of the grate shafts 6 is illustrated in FIGS. 16A-C.

As illustrated in FIGS. 4 to 7, the plate-formed grate element 1 according to the present invention is further provided with an internal cooling fluid chamber 18 including an internal front cooling fluid channel 19 having an inlet end 20 and an outlet end 21 and extending along the front end 14 of the plate-formed grate element 1 and above a part of the lower inwardly curved wall portion 16 of the front end 14.

Figure 1:
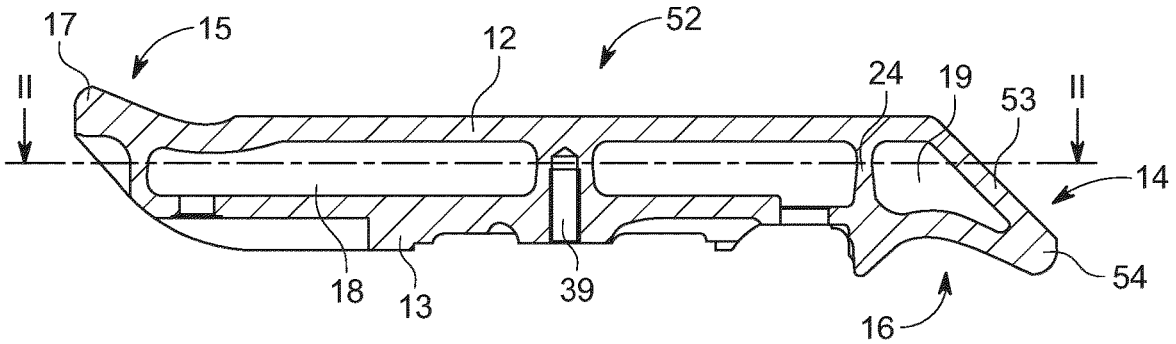
Figure 2:
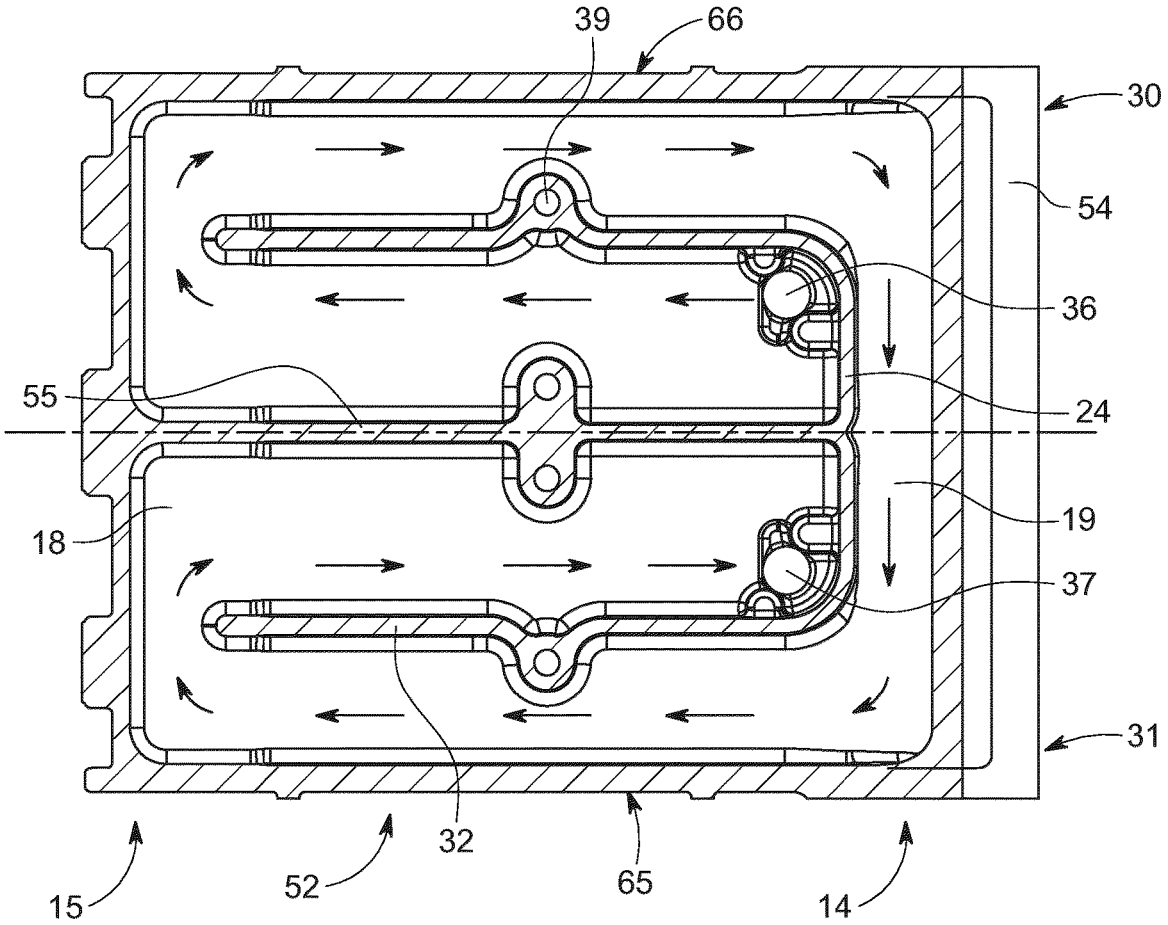
FIG. 2 is a cross-section taken along the line II-II of the prior art plate-formed grate element of FIG. 1.
Figure 3:
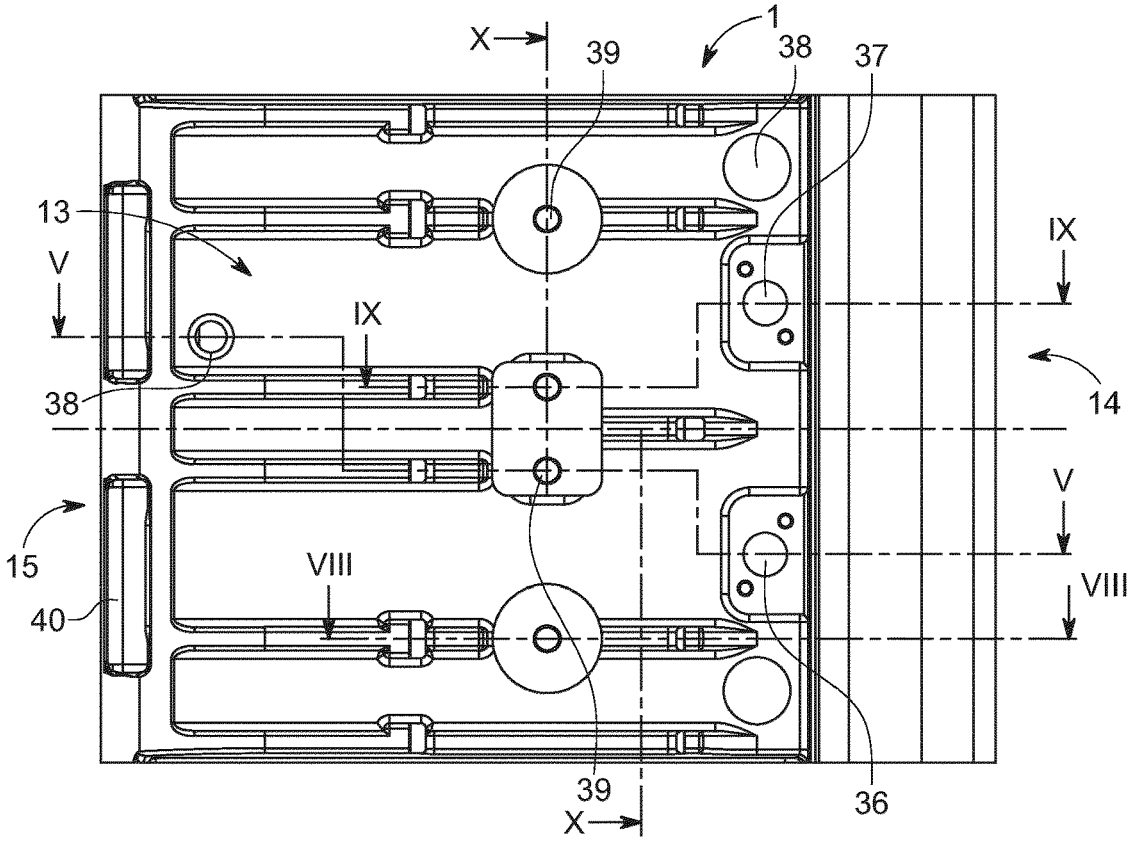
FIG. 3 is a bottom view of a plate-formed grate element according to the present invention, for a movable grate of a furnace.

FIGS. 1 and 2 illustrate a known plate-formed grate element 52. This prior art plate-formed grate element 52 also has a top wall 12, a bottom wall 13, a front end 14 and a back end 15. The front end 14 of the prior art plate-formed grate element 52 has a lower inwardly curved wall portion 16 and is further provided with an internal cooling fluid chamber 18 including an internal front cooling fluid channel 19 having an inlet end and an outlet end 21 and extending along the front end 14 of the prior art plate-formed grate element 52 and above a part of the lower inwardly curved wall portion 16 of the front end 14. The prior art plate-formed grate element 52 has a straight front wall 53 extending from the top wall 12 of the prior art plate-formed grate element 52 to the lower inwardly curved wall portion 16 of the front end 14. As seen, the straight front wall 53 forms an oblique angle with the top wall 12 and forms a pointed front tip edge 54 at its connection with the lower inwardly curved wall portion 16. The pointed front tip edge 54 is located below the bottom wall 13. As seen in FIG. 1, the top wall 12 and the bottom wall 13 extend generally in parallel and in a spaced configuration, and the top wall 12 and the bottom wall 13 are connected at the front end 14 of the plate-formed grate element 52 by means of the straight front wall 53. Thereby, the straight front wall 53 extends from the top wall 12 of the plate-formed grate element 52 to the position of the pointed front tip edge 54 which is below the general level of the bottom wall 13. At the pointed front tip edge 54, the straight front wall 53 is connected with the bottom wall 13 by means of the lower inwardly curved wall portion 16.

The pointed front tip edge 54 of the prior art plate-formed grate element 52 may during operation be subject to a significant temperature gradient due to a substantial mass concentration in the pointed front tip edge 54. Furthermore, it is noted that a predominant part of the flow of cooling fluid is relatively distant from the pointed front tip edge 54 where the temperature may be elevated. The temperature of the pointed front tip edge 54 may during operation reach up to about 900 degrees Celsius.

Figure 8:
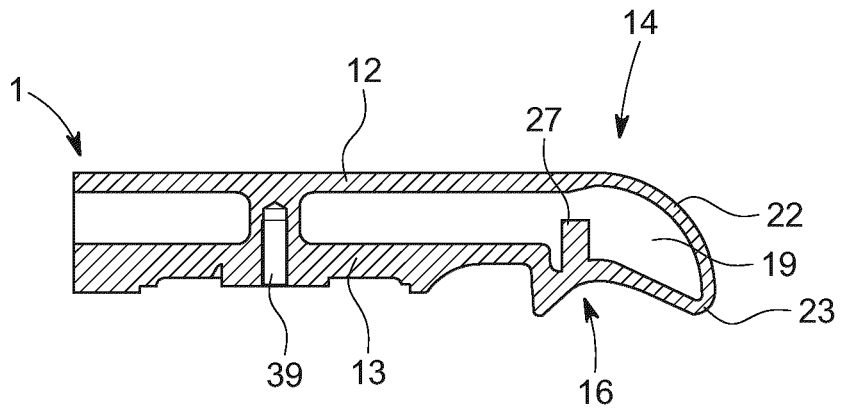
FIG. 8 is a cross-section taken along the line VIII-VIII of the plate-formed grate element as illustrated in FIG. 3.
Figure 9:
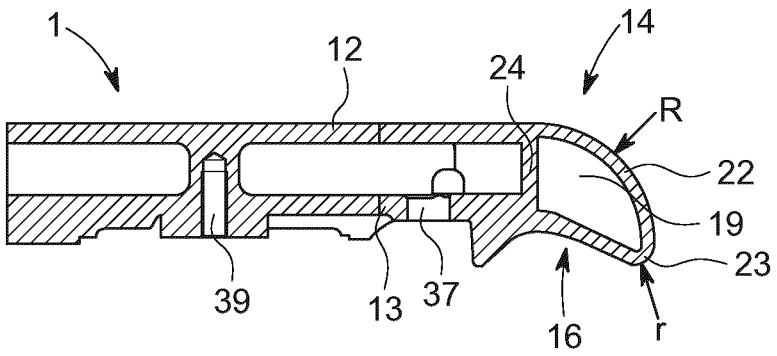
FIG. 9 is a cross-section taken along the line IX-IX of the plate-formed grate element as illustrated in FIG. 3.
Figure 10:
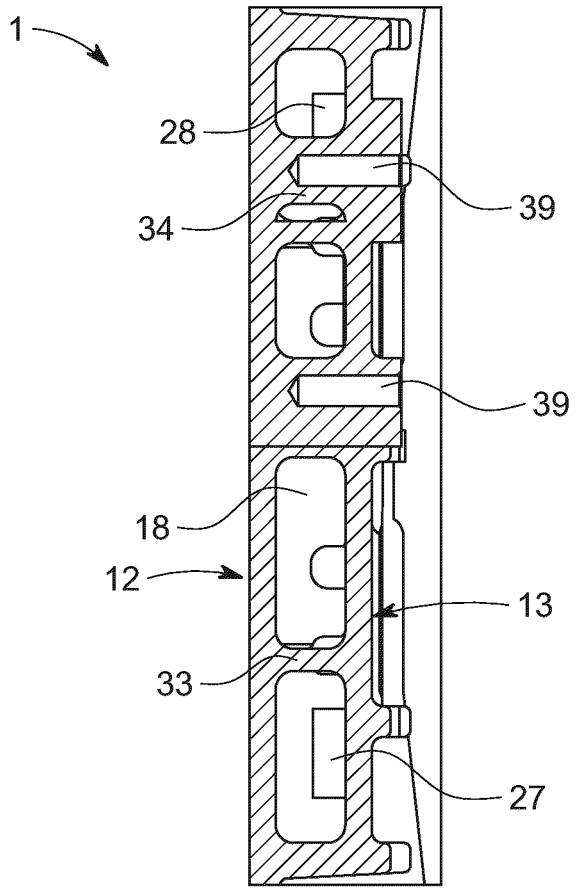
FIG. 10 is a cross-section taken along the line X-X of the plate-formed grate element as illustrated in FIG. 3.
Figure 11:
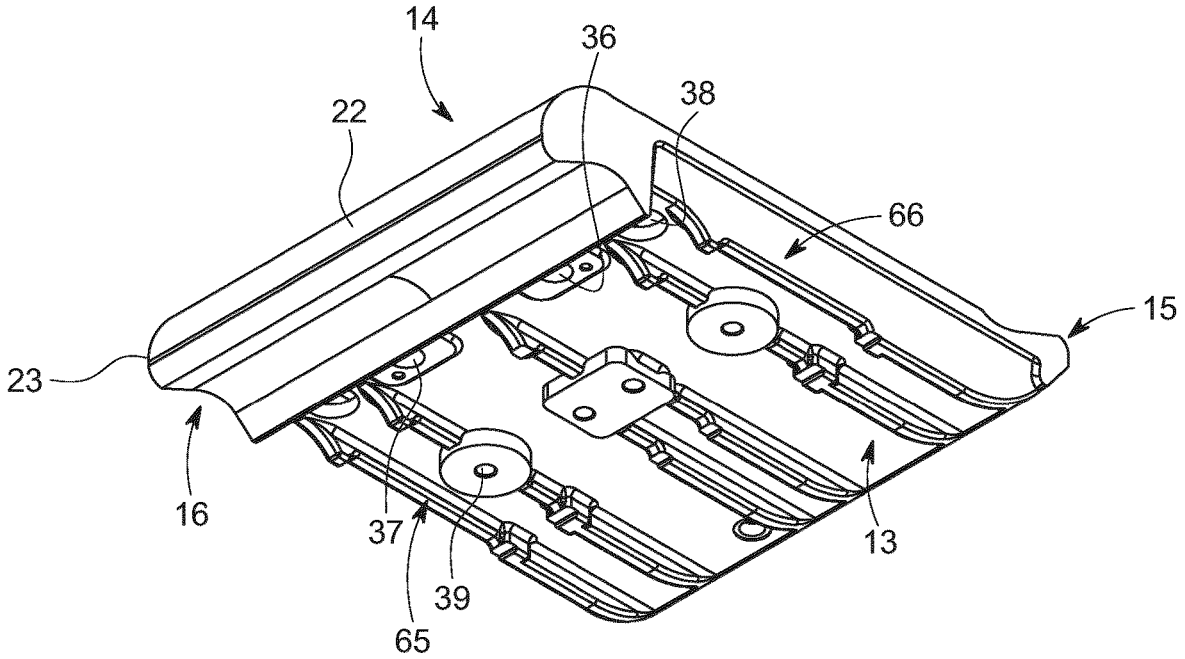
FIG. 11 is a perspective view seen obliquely from below of the plate-formed grate element according to the present invention as illustrated in FIG. 3.
Figure 12:
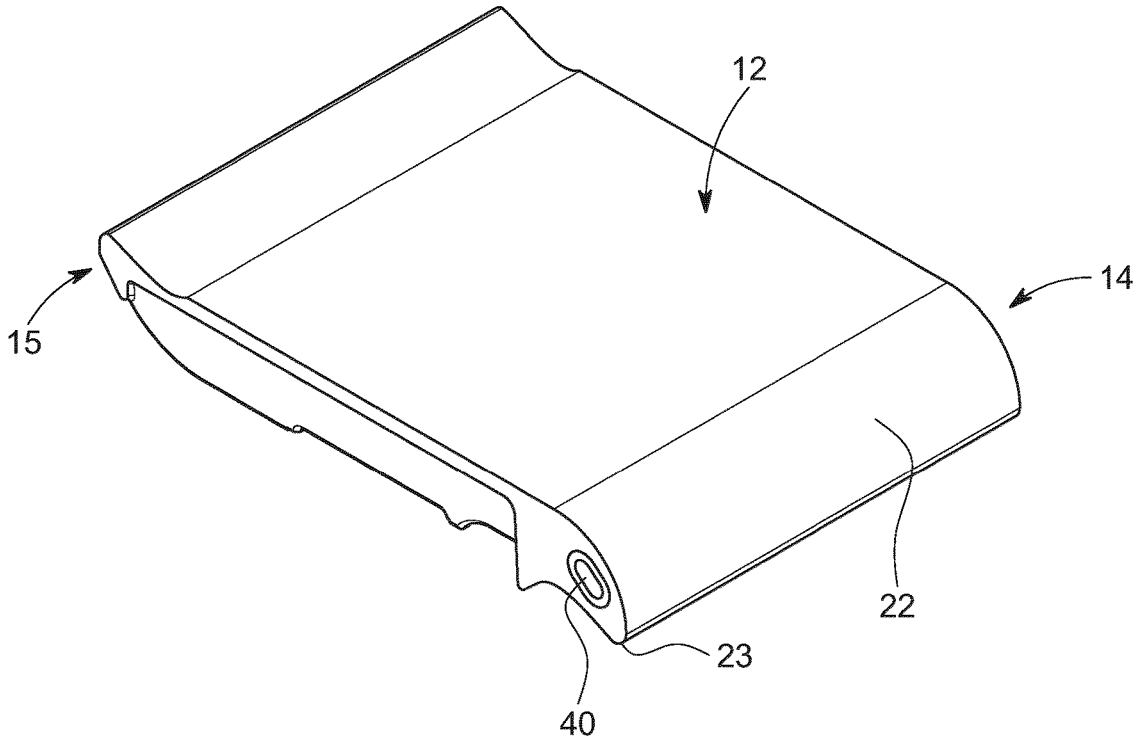
FIG. 12 is a perspective view seen obliquely from above of the plate-formed grate element according to the present invention as illustrated in FIG. 3.

As illustrated in FIGS. 5, 8 and 9, according to the present invention, on the contrary, the plate-formed grate element 1 has an outwardly curved or rounded front wall 22 extending from the top wall 12 of the plate-formed grate element 1 to the lower inwardly curved wall portion 16 of the front end 14. A front tip edge 23 of the front end 14 is formed by the outwardly curved front wall 22 at its connection with the lower inwardly curved wall portion 16. Thereby, in operation, relatively more cooling fluid may flow close to the front tip edge 23 of the plate-formed grate element 1 as compared to prior art grate elements, such as the known plate-formed grate element 52 illustrated in FIGS. 1 and 2. In addition, the cooling fluid may generally flow closer to the front tip edge 23 of the inventive plate-formed grate element 1 as compared to the prior art grate elements. Consequently, a better and more efficient cooling the front end 14 and in particular of the front tip edge 23 may be achieved according to the present invention. Furthermore, according to the present invention, the outwardly curved front wall 22 has a nominal wall thickness varying by less than ±35 percent. Thereby, the effect of the cooling fluid is evened out over the outwardly curved front wall and thereby an even cooling of the front wall may be obtained. In particular, it may be possible to avoid insufficient cooling of the front tip edge 23. As an example, the temperature of the front tip edge 23 of the plate-formed grate element 1 according to the present invention may during operation reach no more than 300 degrees Celsius in a furnace setup in which the pointed front tip edge 54 of the prior art plate-formed grate element 52 of FIGS. 1 and 2 would reach almost 900 degrees Celsius. This means that a temperature reduction of up to about 600 degrees Celsius may be obtained by means of the plate-formed grate element 1 according to the invention.

A better cooling of the front tip edge 23 may result in less wear of the front tip edge and therefore a longer service life of the plate-formed grate elements 1. Furthermore, a smooth curvature of the entire outwardly curved front wall may result in a stronger front wall without weak areas in which tension may build up.

According to the present invention, preferably, the front tip edge 23 is located below the general level of the bottom wall 13. As seen in FIGS. 4 and 5, furthermore, the top wall 12 and the bottom wall 13 may extend generally in parallel and in a spaced configuration, and the top wall 12 and the bottom wall 13 are connected at the front end 14 of the plate-formed grate element 1, 2 by means of the outwardly curved front wall 22. Thereby, the outwardly curved front wall 22 may extend from the top wall 12 of the plate-formed grate element 1, 2 to a position of the front tip edge 23 which is below the general level of the bottom wall 13. At the front tip edge 23, the outwardly curved front wall 22 is connected with the bottom wall 13 by means of the lower inwardly curved wall portion 16.

According to the present invention, preferably, the outwardly curved front wall 22 is continuously rounded from the top wall 12 of the plate-formed grate element 1 to the lower inwardly curved wall portion 16 of the front end 14 so that the outwardly curved front wall 22 forms a convex part of the front end 14 and the lower inwardly curved wall portion 16 forms a concave part of the front end 14.

As further illustrated in FIGS. 13 to 15, according to the present invention, the first half plate-formed grate element 2 also has an outwardly curved or rounded front wall 22 extending from the top wall 12 of the first half plate-formed grate element 2 to the lower inwardly curved wall portion 16 of the front end 14. A front tip edge 23 of the front end 14 is formed by the outwardly curved front wall 22 at its connection with the lower inwardly curved wall portion 16. As it will be understood, the design of the front end 14 of the first half plate-formed grate element 2 as illustrated in FIGS. 13 to 15 corresponds to the design of the front end 14 of the full-sized plate-formed grate element 1 as illustrated in FIGS. 6 to 12. Therefore, the same advantages as explained above in relation to the full-sized plate-formed grate element 1 may also be achieved by means of the first half plate-formed grate element 2.

On the other hand, as mentioned above, the design of the back end 15 of the first half plate-formed grate element 2 differs from the design of the back end 15 of the full-sized plate-formed grate element 1. As it is understood, the back end 15 of the first half plate-formed grate element 2 is shorter than the back end 15 of the full-sized plate-formed grate element 1. Comparing FIGS. 7 and 14, it is seen that in the first half plate-formed grate element 2, the internal cooling fluid chamber is smaller than the internal cooling fluid chamber of the full-sized plate-formed grate element 1, and the free ends 35 of the internal side separating walls 33, 34 are closer to the back end 15 than in the full-sized plate-formed grate element 1.

The plate-formed grate element 1, 2 according to the present invention may preferably be produced in one single piece of metal in a sand casting process. Subsequently, the casting may be machined to accurate measurements and casting holes 38 and/or casting slots 40 may be tapped by suitable plugs by welding or any other suitable procedure. The sand casting process may for instance be of the lost foam type or any other suitable sand casting process. However, of course, the plate-formed grate element 1, 2 according to the present invention may be produced in any suitable way, such as by any suitable casting process or machining process or even in a 3D printing process. The plate-formed grate element 1, 2 may also be assembled from any suitable number of elements.

The nominal wall thickness of the outwardly curved front wall 22 may advantageously vary by less than ±30 percent, preferably less than ±25 percent, and most preferred less than ±20 percent. By reducing the variation of the nominal wall thickness of the outwardly curved front wall 22 even further, it may be possible to further even out the effect of the cooling fluid over the outwardly curved front wall 22 and thereby to a higher degree obtain even cooling of the front wall. In particular, it may be possible to avoid insufficient cooling of the front tip edge 23.

Preferably, the outwardly curved front 22 wall has an at least substantially constant wall thickness.

Referring to FIG. 9, the part of the outwardly curved front wall 22 extending from the top wall 12 of the plate-formed grate element 1, 2 to the front tip edge 23 may advantageously have an outer contour with a first nominal radius of curvature R varying by less than ±40 percent, and preferably less than ±20 percent. The front tip edge 23 may advantageously have an outer contour with a second nominal radius of curvature r varying by less than ±20 percent. Advantageously, the first nominal radius of curvature R is more than 2 times larger, preferably more than 3 times larger, more preferred more than 4 times larger and most preferred more than 5 times larger than the second nominal radius of curvature r. Thereby, it may in particular be possible to concentrate the effect of the cooling fluid flowing closer to the front tip edge 23 of the plate-formed grate element 1.

According to the invention, the outwardly curved front wall 22 of the plate-formed grate element 1, 2 may advantageously have an outer contour with a first nominal radius of curvature R, wherein the first nominal radius of curvature R is constant, constantly increases or constantly decreases, from the top wall 12 of the plate-formed grate element 1, 2 to the front tip edge 23.

Figure 6:
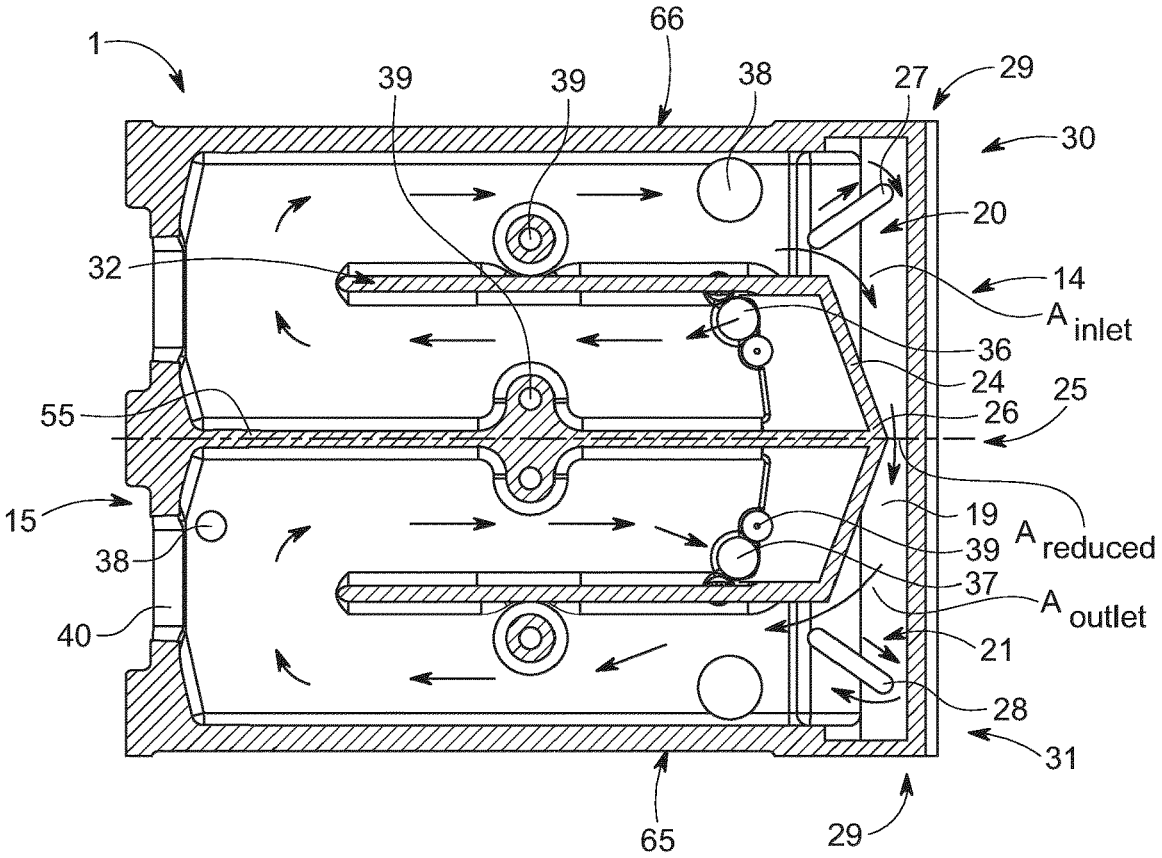
FIG. 6 is a cross-section taken along the line VI-VI of the plate-formed grate element as illustrated in FIG. 4.
Figure 7:
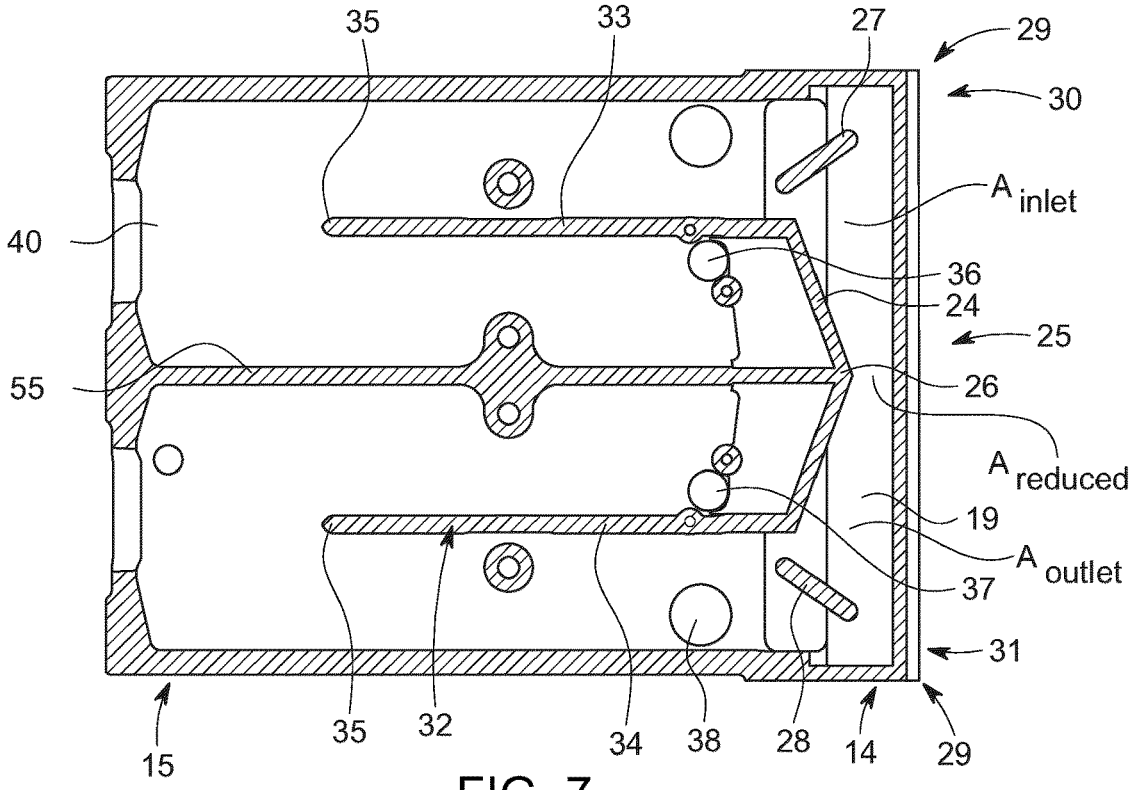
FIG. 7 is a cross-section taken along the line VII-VII of the plate-formed grate element as illustrated in FIG. 4.

Referring in particular to FIGS. 5 to 9, it is seen that in the illustrated embodiment, the internal front cooling fluid channel 19 is formed by the outwardly curved front wall 22, a part of the lower inwardly curved wall portion 16 of the front end 14, and a front internal separating wall 24 connecting the top wall 12 and the bottom wall 13 of the plate-formed grate element 1. As illustrated in FIGS. 6 and 7, at a central position 25 of the front end 14, the front internal separating wall 24 forms a restriction 26 of a cross-sectional flow area of the internal front cooling fluid channel 19. Thereby, it may be possible to obtain a generally higher velocity of the cooling fluid close to the front tip edge 23 of the plate-formed grate element 1, thereby improving the cooling effect at the front tip edge 23.

In the illustrated embodiment, the restriction 26 of the cross-sectional flow area of the internal front cooling fluid channel 19 is formed gradually from the inlet end 20 to the outlet end 21 of the internal front cooling fluid channel 19. Thereby, an even cooling effect may be obtained along the front end 14 and in particular along the front tip edge 23 of the plate-formed grate element 1. In particular, as seen, the restriction 26 of the cross-sectional flow area of the internal front cooling fluid channel 19 is formed in that the front internal separating wall 24 is V-formed. Alternatively, the restriction 26 could be formed by means of the front internal separating wall 24 being curved in a longitudinal direction of the front internal separating wall 24.

A reduced cross-sectional flow area $A_{reduced}$ at said restriction 26 may be less than 60 percent, preferably less than 50 percent, and most preferred less than 40 percent of an inlet/outlet cross-sectional flow area $A_{inlet}$, $A_{outlet}$ at the inlet and/or outlet end 20, 21 of the internal front cooling fluid channel 19. Thereby, an even cooling effect may be obtained along the front end 14 and in particular along the front tip edge 23 of the plate-formed grate element 1.

Referring to FIGS. 6 and 7, optionally, an internal inlet guide vane 27 is arranged in the internal cooling fluid chamber 18 at the inlet end 20 of the internal front cooling fluid channel 19, and, optionally, an internal outlet guide vane 28 is arranged in the internal cooling fluid chamber 18 at the outlet end 21 of the internal front cooling fluid channel 19. Said internal inlet guide vane 27 and said internal outlet guide vane 28 are adapted to guide cooling fluid in the direction of respective corners 29 of the internal cooling fluid chamber 18 at respective sides 30, 31 of the front end 14 of the plate-formed grate element 1. Thereby, as illustrated by means of arrows in FIG. 6, more cooling fluid may be guided to the corners 29 of the internal cooling fluid chamber 18 and the cooling effect may be improved at the sides 30, 31 of the front end 14 and in particular of the front tip edge 23 of the plate-formed grate element 1.

Referring in particular to FIG. 8, and comparing FIGS. 6 and 7, it is seen that the internal inlet guide vane 27 is connected to the bottom wall 13 of the plate-formed grate element 1 and is spaced in relation to the top wall 12 being opposed to the bottom wall 13 to which the internal inlet guide vane 27 is connected. In the same way, the internal outlet guide vane 28 is connected to the bottom wall 13 of the plate-formed grate element 1 and is spaced in relation to the top wall 12 being opposed to the bottom wall 13 to which the internal outlet guide vane 28 is connected. Thereby, cooling fluid may be guided in the direction of the respective corners 29 of the internal cooling fluid chamber 18 without limiting the general flow of cooling fluid too much. Furthermore, the production of the plate-formed grate element 1 by casting may be facilitated in that casting sand may better pass through the internal cooling fluid chamber 18 of the plate-formed grate element 1. The result may therefore be a casting of better quality having a longer service life.

It is understood that exactly the same advantages could be achieved if the internal inlet guide vane 27 is connected to the top wall 12 of the plate-formed grate element 1 and is spaced in relation to the bottom wall 13. Similarly, of course, the same advantages could be achieved if the internal outlet guide vane 28 is connected to the top wall 12 of the plate-formed grate element 1 and is spaced in relation to the bottom wall 13. For instance, the internal inlet guide vane 27 could be connected to the top wall 12 and be spaced in relation to the bottom wall 13, and the internal outlet guide vane 28 could be connected to the bottom wall 13 and be spaced in relation to the top wall 12, or vice versa.

As seen in FIGS. 6 and 7, the internal inlet guide vane 27 and the internal outlet guide vane 28 are arranged at an oblique angle in relation to a longitudinal direction of the front end 14, said longitudinal direction extending from the first side 30 of the front end 14 to the second side 31 of the front end 14. Thereby, the cooling fluid may be guided to maximise the cooling effect at either side 30, 31 of the front end 14 and in particular of the front tip edge 23 of the plate-formed grate element 1, at respective corners 29 of the internal cooling fluid chamber 18.

As seen in FIGS. 6 and 7, a U-formed internal separating wall 32 arranged in the internal cooling fluid chamber 18 is composed by an intermediate wall part in the form of the front internal separating wall 24 and two internal side separating walls 33, 34. The two internal side separating walls 33, 34 have respective free ends 35 located at a distance from the back end 15 of the plate-formed grate element 1. Each of the internal inlet guide vane 27 and the internal outlet guide vane 28 are spaced in relation to the U-formed internal separating wall 32. Thereby, a sufficient amount of cooling fluid may be guided to the corners 29 of the internal cooling fluid chamber 18 and a sufficient amount of cooling fluid may be guided directly through the internal front cooling fluid channel 19, whereby a balanced cooling effect may be obtained both at the sides 30, 31 of the front end 14 and in particular of the front tip edge 23 of the plate-formed grate element 1. Furthermore, the production of the plate-formed grate element 1 by casting may be even further facilitated in that casting sand may better pass through the internal cooling fluid chamber 18 of the plate-formed grate element 1.

As further seen in FIGS. 6 and 7, a central longitudinal separating wall 55 extends from a back wall of the internal cooling fluid chamber 18 to the front internal separating wall 24, thereby separating the internal cooling fluid chamber 18 into a first inlet chamber part and a second outlet chamber part. Thereby, as illustrated by means of the arrows in FIG. 6, cooling fluid may be guided from a cooling fluid inlet opening 36 of the internal cooling fluid chamber 18, around the first internal side separating wall 33, through the internal front cooling fluid channel 19, around the second internal side separating wall 34 and out through a cooling fluid outlet opening 37 of the internal cooling fluid chamber 18. The cooling fluid inlet opening 36 is adapted for connection with an inlet cooling fluid tube 49, and the cooling fluid outlet opening 37 is adapted for connection with an outlet cooling fluid tube 50.

As illustrated in FIGS. 19 to 22, cooling fluid, typically a liquid, such as water, may be supplied to the plate-formed grate elements 1, 2 by means of an inlet cooling fluid tube 49 arranged in respective girders 48 forming part of each respective grate shaft 6 and carrying the plate-formed grate elements 1, 2. Similarly, the cooling fluid may flow away from the plate-formed grate elements 1, 2 through an outlet cooling fluid tube 50 arranged in the girder 48. As seen, thereby, the internal cooling fluid chambers 18 of the plate-formed grate elements of a grate shaft 6 may be connected in series. The plate-formed grate elements 1, 2 are mounted on the girders 48 by means of not shown bolts screwed into threaded mounting holes 39 of the plate-formed grate elements.

However, the plate-formed grate elements 1, 2 may be arranged in different ways than illustrated, and cooling fluid, typically a liquid, such as water, may be supplied to the plate-formed grate elements 1, 2 in different ways than illustrated. In any way, the internal cooling fluid chamber 18 of each plate-formed grate element 1, 2, may in the mounted state of the plate-formed grate element 1, 2 in a grate lane 41, 42 form part of a cooling circuit through which cooling fluid may be circulated. Thereby, a number of internal cooling fluid chambers 18 of respective plate-formed grate elements may be connected in series. The cooling fluid inlet opening 36 of the internal cooling fluid chamber 18 may be adapted for connection with a cooling fluid conduit of a cooling circuit and the cooling fluid outlet opening 37 of the internal cooling fluid chamber 18 is adapted for connection with a cooling fluid conduit of the cooling circuit. Said cooling circuit is typically a closed cooling circuit.

As illustrated in FIG. 19, at each side of each grate lane 41, 42, two air-cooled plate-formed grate elements 51 without internal cooling fluid chambers are arranged, because the requirement for cooling may be less at the sides of the grate lanes.

Test Results

FIG. 24 is a photograph of a furnace having a movable grate 5 corresponding to the illustration in FIG. 18. However, whereas the movable grate 5 illustrated in FIG. 18 is provided with plate-formed grate elements 1, 2 according to the present invention, the movable grate 5 seen in the photograph of FIG. 24 was firstly provided with prior art plate-formed grate elements 52 as illustrated in FIGS. 1 and 2.

In the furnace of FIG. 24, fuel including predominantly shredded waste wood has been burned. The movable grate 5 seen in the photograph of FIG. 24 has been in operation during only approximately 6 months after being provided with newly manufactured, prior art plate-formed grate elements 52 as illustrated in FIGS. 1 and 2. Corresponding to the movable grate 5 illustrated in FIG. 18, the movable grate 5 of FIG. 24 has a left grate lane 41 and a right grate lane 42. Each grate lane 41, 42 has a first section 43, on which the fuel enters, a second section 44, a third section 45, and a fourth section 46 (barely visible in the photograph), from which the fuel finally exits. The first and second sections 43, 44 include prior art plate-formed grate elements 52 provided with internal cooling fluid chambers 18 as illustrated in FIGS. 1 and 2. The third and fourth sections are cooled by means of primary combustion air so that the plate-formed grate elements of these sections are not provided with internal cooling fluid chambers.

Figure 25:
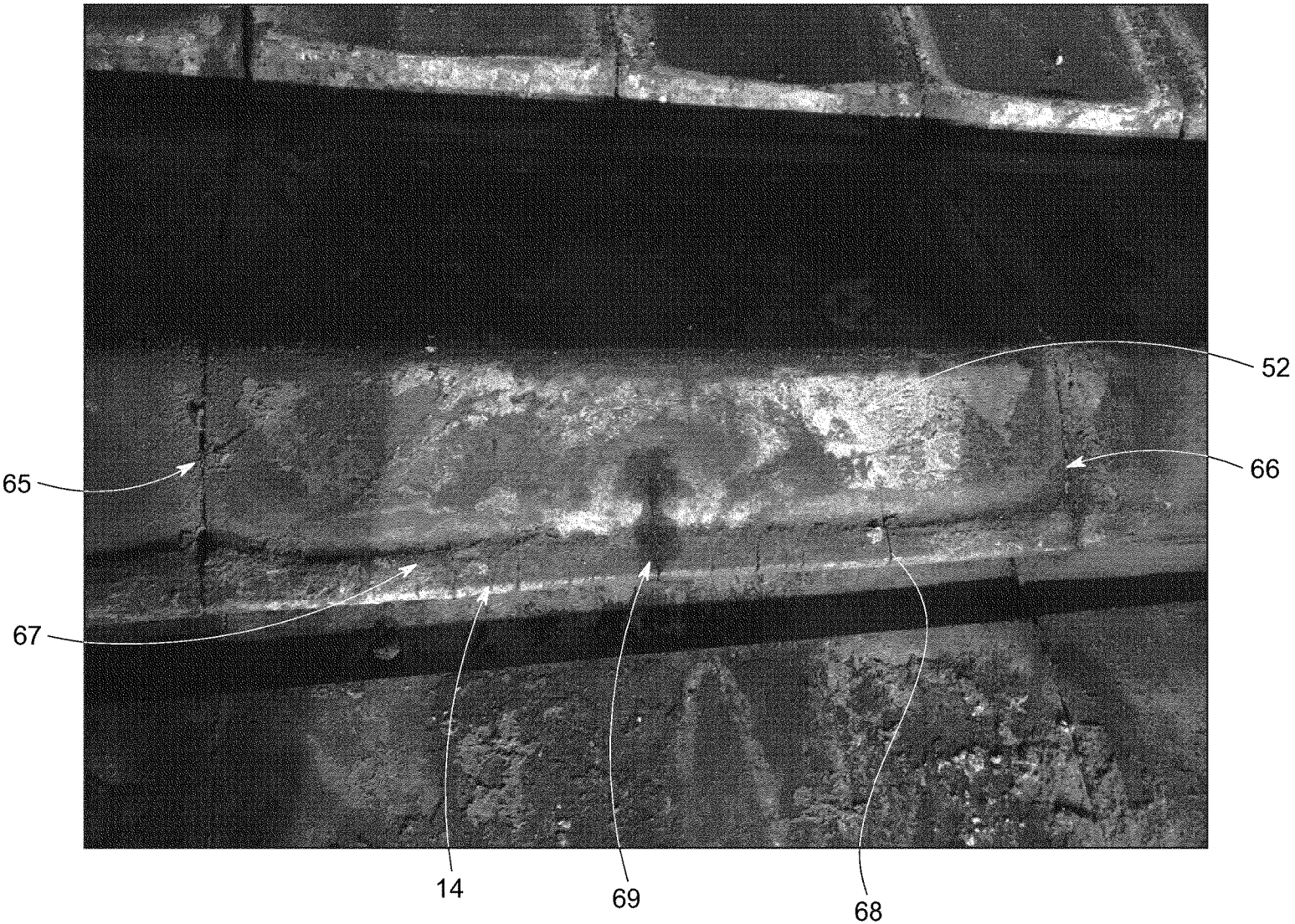

FIG. 25 is a photo of one of the prior art plate-formed grate elements 52 of the second section 44 of the movable grate 5 of FIG. 24. The photo of FIG. 25 shows the front end 14 of the plate-formed grate element 52. The plate-formed grate element 52 has a left side 66 and a right side 65 abutting neighbouring plate-formed grate elements 52. Comparing the photo of FIG. 25 of the used prior art plate-formed grate element 52 with the illustration of FIG. 1 of a newly manufactured prior art plate-formed grate element 52, it is seen that a lot of material has been worn away by corrosion from the front end 14 of the plate-formed grate element 52, thereby forming a trough 67 along the front end 14. Moreover, a lot of micro cracks 68 have been formed along the edge of the front end 14 as a result of tensions in the material. One of the micro cracks 68 has formed a leak 69 from the internal cooling fluid chamber 18 of the plate-formed grate element 52. The leak 69 is seen as having a darker spot around its micro crack 68 as a result of cooling water leaking from the internal front cooling fluid channel 19 of the internal cooling fluid chamber 18. Clearly, this plate-formed grate element 52 must already be replaced by a new grate element at this point after only 6 months of service.

Figure 26:
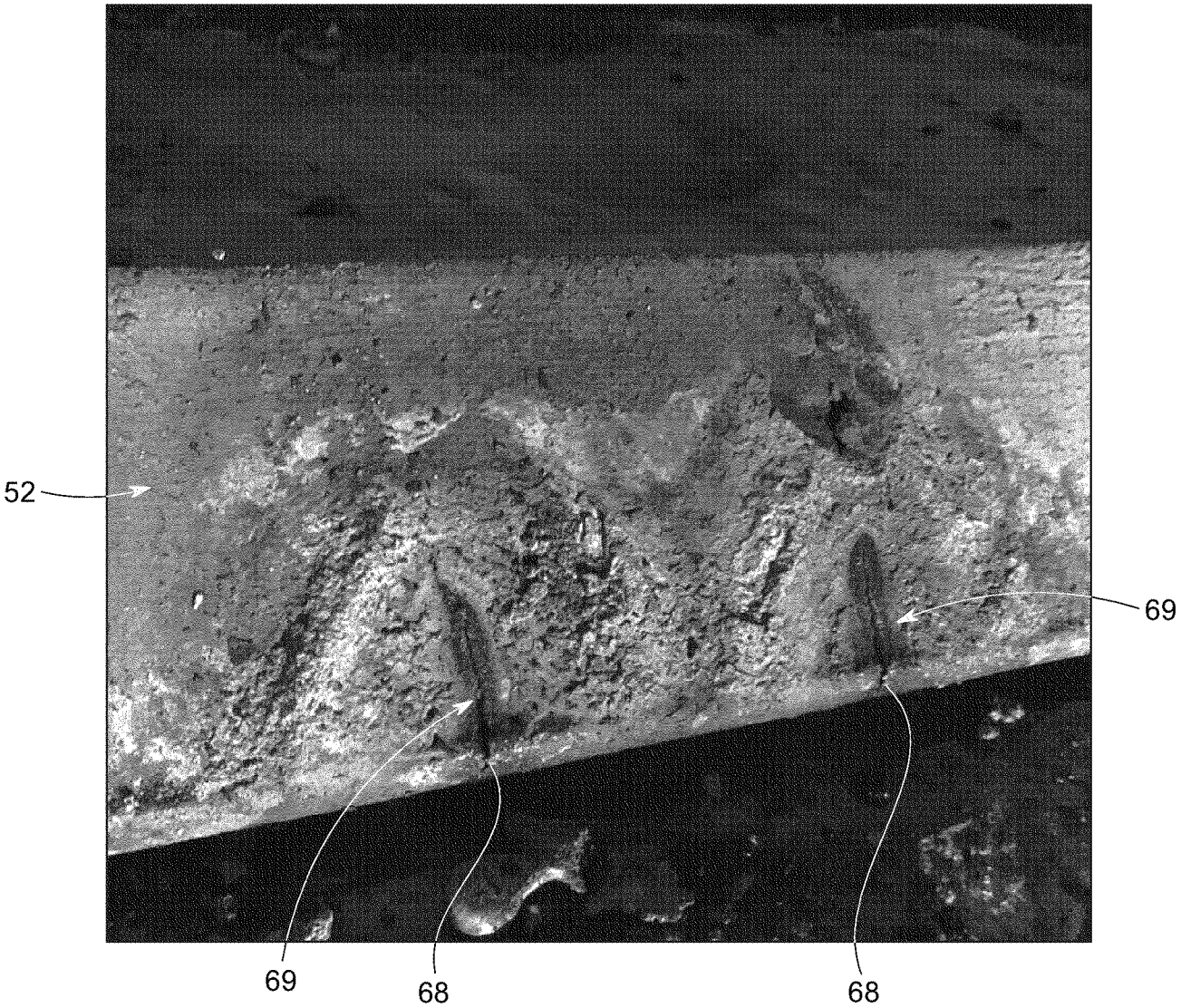

FIG. 26 is a close-up photograph of another example of a prior art plate-formed grate element 52 of the second section 44 of the movable grate 5 of FIG. 24. In FIG. 26, two micro cracks 68 have formed respective leaks 69 seen as having a darker spot around their micro cracks 68 as a result of cooling water leaking from the internal cooling fluid chamber 18.

FIG. 27 is a photo of one of the prior art plate-formed grate elements 52 of the first section 43 of the movable grate 5 of FIG. 24. The photo of FIG. 27 shows the front end 14 of the plate-formed grate element 52. The plate-formed grate element 52 has a left side 66 and a right side 65 abutting neighbouring plate-formed grate elements 52. Comparing the photo of FIG. 27 of the used prior art plate-formed grate element 52 with the illustration of FIG. 1 of a newly manufactured prior art plate-formed grate element 52, it is seen that a number of rough dents 70 have formed in the pointed front tip edge 54 of the prior art plate-formed grate element 52. In this case, no micro cracks or leaks have been formed yet. Apparently, because the corrosion in the first section 43 is even stronger than the corrosion in the second section 44, the deep, broad dents 70 have been formed, thereby removing a substantial part of the material of the pointed front tip edge 54. Although no leaks have been formed yet, it is clear that also this plate-formed grate element 52 must already be replaced by a new grate element at this point after only 6 months of service.

FIG. 28 is a photo of another one of the prior art plate-formed grate elements 52 of the first section 43 of the movable grate 5 of FIG. 24. The photo of FIG. 28 shows in close-up a corner of the first side 30 of the front end 14 of the plate-formed grate element 52. It is seen that a deep rounded trough 71 has been formed on the top of said corner of the pointed front tip edge 54 of the prior art plate-formed grate element 52. Furthermore, a number of dents 70 have been formed in the pointed front tip edge 54.

In fact, due to excessive wear, most of the prior art plate-formed grate elements 52 of the first and second sections 43, 44 had to be replaced.

Subsequently, the first and second sections 43, 44 of the movable grate 5 illustrated in FIG. 24 was provided with plate-formed grate elements 1 according to the present invention and as illustrated in FIGS. 3 to 12. As for the test described above, the same type of fuel including predominantly shredded waste wood was burned in the furnace for a period of operation of approximately 6 months after the installation of the newly manufactured plate-formed grate elements 1 according to the present invention. FIGS. 29 and 30 are photos of one of said plate-formed grate elements 1 according to the present invention after the approximately 6 months of operation. Only one of said plate-formed grate elements 1 is shown, because in reality, there was no visible difference in the appearance of the various plate-formed grate elements 1.

As seen in FIGS. 29 and 30, absolutely no micro cracks, dents or troughs have been formed in the front end 14 of the plate-formed grate element 1 according to the present invention. Interestingly, in the close-up photo of FIG. 30, it is seen that along the rounded front tip edge 23 of the front end 14 of the plate-formed grate element 1, milling marks 72 in the form of vertical lines in the figure are still visible after the approximately 6 months of operation. These milling marks 72 were provided when machining the casted plate-formed grate element 1 to accurate measurements as described above. However, the presence of these milling marks 72 after approximately 6 months of operation proves that in reality, substantially no material has been worn away from the front end 14 of the plate-formed grate element 1.

As a result of the test, it may therefore be concluded that the plate-formed grate element 1 according to the present invention as illustrated in FIGS. 3 to 12 is significantly less prone to wear than the prior art plate-formed grate element 52 as illustrated in FIGS. 1 and 2.

LIST OF REFERENCE NUMBERS $A_{reduced}$ reduced cross-sectional flow area at restriction of internal front cooling fluid channel $A_{inlet}$ inlet cross-sectional flow area at inlet end of internal front cooling fluid channel $A_{outlet}$ outlet cross-sectional flow area at outlet end of internal front cooling fluid channel R first nominal radius of curvature r second nominal radius of curvature

1 full-sized plate-formed grate element
2 first half plate-formed grate element
3 last half plate-formed grate element
4 fixed plate-formed grate element
5 movable grate of furnace
6 pivotal grate shaft
7 inclined grate surface
8 drive mechanism
9 synchronising mechanism
10 predetermined clearance between plate-formed grate elements
11 edge portion of plate-formed grate element
12 top wall of plate-formed grate element
13 bottom wall of plate-formed grate element
14 front end of plate-formed grate element
15 back end of plate-formed grate element
16 lower inwardly curved wall portion of front end
17 back tip edge of back end
18 internal cooling fluid chamber of plate-formed grate element
19 internal front cooling fluid channel of plate-formed grate element
20 inlet end of internal front cooling fluid channel
21 outlet end of internal front cooling fluid channel
22 outwardly curved front wall of plate-formed grate element
23 rounded front tip edge of front end
24 front internal separating wall of internal cooling fluid chamber
25 central position of front end
26 restriction of internal front cooling fluid channel
27 internal inlet guide vane of internal cooling fluid chamber
28 internal outlet guide vane of internal cooling fluid chamber
29 corner of internal cooling fluid chamber
30 first side of front end of plate-formed grate element
31 second side of front end of plate-formed grate element
32 U-formed internal separating wall of internal cooling fluid chamber
33 first internal side separating wall of internal cooling fluid chamber
34 second internal side separating wall of internal cooling fluid chamber
35 free end of internal side separating wall
36 cooling fluid inlet opening of internal cooling fluid chamber
37 cooling fluid outlet opening of internal cooling fluid chamber
38 casting hole to be tapped
39 threaded mounting hole of plate-formed grate element
40 casting slot to be tapped
41 left grate lane
42 right grate lane
43 first section of grate lane
44 second section of grate lane
45 third section of grate lane
46 fourth section of grate lane
47 stationary inlet connection plate
48 girder carrying plate-formed grate elements
49 inlet cooling fluid tube in girder

50 outlet cooling fluid tube in girder
51 air-cooled plate-formed grate element
52 prior art full-sized plate-formed grate element
53 straight front wall of plate-formed grate element
54 pointed front tip edge of prior art plate-formed grate element
55 central longitudinal separating wall of internal cooling fluid chamber
56 frame of movable grate
57 synchronising rod
58 first synchronising lever arm
59 second synchronising lever arm
60 linear actuator of drive mechanism
61 first linking rod
62 second linking rod
63 crank arm
64 disc springs of biasing mechanism
65 left side of plate-formed grate element
66 right side of plate-formed grate element
67 trough along front end of plate-formed grate element
68 micro crack
69 leak
70 dent in pointed front tip edge
71 trough
72 milling mark

The invention claimed is:

1. A plate-formed grate element for a movable grate of a furnace, the movable grate including a number of pivotal grate shafts carrying plate-formed grate elements and thereby defining an inclined grate surface, the movable grate including a drive mechanism being arranged for pivoting back and forth neighbouring grate shafts in opposite rotational directions so as to impart a wave-like movement to material on the grate surface in order to transport such material downwards, and the movable grate including a synchronising mechanism being arranged to maintain a predetermined clearance between edge portions of plate-formed grate elements of neighbouring grate shafts during the pivoting movement of the grate shafts, the plate-formed grate element having a top wall, a bottom wall, a front end and a back end, the front end of the plate-formed grate element having a lower inwardly curved wall portion being adapted to maintain said predetermined clearance with a back tip edge of the back end of an adjacent plate-formed grate element during part of said pivoting movement of the grate shafts when said plate-formed grate elements are arranged on neighbouring grate shafts, and the plate-formed grate element being provided with an internal cooling fluid chamber including an internal front cooling fluid channel having an inlet end and an outlet end and extending along the front end of the plate-formed grate element and above at least a part of the lower inwardly curved wall portion of the front end, wherein the plate-formed grate element has an outwardly curved front wall extending from the top wall of the plate-formed grate element to the lower inwardly curved wall portion of the front end, wherein a front tip edge of the front end is formed by the outwardly curved front wall at its connection with the lower inwardly curved wall portion, and wherein the outwardly curved front wall has a nominal wall thickness varying by less than ±35 percent, wherein the part of the outwardly curved front wall extending from the top wall of the plate-formed grate element to the front tip edge has an outer contour with a first nominal radius of curvature (R) varying by less than ±40 percent, wherein the front tip edge has an outer contour with a second nominal radius of curvature (r) varying by less than ±20 percent, and wherein the first nominal radius of curvature (R) is more than 2 times larger than the second nominal radius of curvature (r).

2. A plate-formed grate element according to claim 1, wherein the nominal wall thickness of the outwardly curved front wall varies by less than ±30 percent.

3. A plate-formed grate element according to claim 1, wherein the first nominal radius of curvature (R) varies by less than ±40 percent and the first nominal radius of curvature (R) is more than 3 times larger than the second nominal radius of curvature (r).

4. A plate-formed grate element according to claim 1, wherein the internal front cooling fluid channel is formed at least by the outwardly curved front wall, at least a part of the lower inwardly curved wall portion of the front end, and a front internal separating wall connecting the top wall and the bottom wall of the plate-formed grate element, and wherein the front internal separating wall, at a central position of the front end, forms a restriction of a cross-sectional flow area of the internal front cooling fluid channel.

5. A plate-formed grate element according to claim 4, wherein the restriction of the cross-sectional flow area of the internal front cooling fluid channel is formed gradually from the inlet end to the outlet end of the internal front cooling fluid channel.

6. A plate-formed grate element according to claim 4, wherein the restriction of the cross-sectional flow area of the internal front cooling fluid channel is formed in that the front internal separating wall is V-formed or curved in a longitudinal direction of the front internal separating wall.

7. A plate-formed grate element according to claim 4, wherein a reduced cross-sectional flow area ($A_{reduced}$) at said restriction is less than 60 percent of an inlet/outlet cross-sectional flow area ($A_{inlet}$, $A_{outlet}$) at the inlet and/or outlet end of the internal front cooling fluid channel.

8. A plate-formed grate element according to claim 1, wherein an internal inlet guide vane is arranged in the internal cooling fluid chamber at the inlet end of the internal front cooling fluid channel, wherein an internal outlet guide vane is arranged in the internal cooling fluid chamber at the outlet end of the internal front cooling fluid channel, and wherein said internal inlet guide vane and said internal outlet guide vane are adapted to guide cooling fluid in the direction of respective corners of the internal cooling fluid chamber at respective ends of the front end of the plate-formed grate element.

9. A plate-formed grate element according to claim 8, wherein the internal inlet guide vane is connected to the top wall or the bottom wall of the plate-formed grate element and is spaced in relation to the top wall or bottom wall being opposed to the top wall or the bottom wall to which the internal inlet guide vane is connected, and wherein the internal outlet guide vane is connected to the top wall or the bottom wall of the plate-formed grate element and is spaced in relation to the top wall or bottom wall being opposed to the top wall or the bottom wall to which the internal outlet guide vane is connected.

10. A plate-formed grate element according to claim 8, wherein the internal inlet guide vane and the internal outlet guide vane are arranged at an oblique angle in relation to a longitudinal direction of the front end.

11. A plate-formed grate element according to claim 8, wherein a U-formed internal separating wall is composed by an intermediate wall part in the form of a front internal separating wall and two internal side separating walls, wherein the two internal side separating walls have respective free ends located at a distance from the back end of the plate-formed grate element, and wherein each of the internal inlet guide vane and the internal outlet guide vane are spaced in relation to the U-formed internal separating wall.

12. A furnace with a movable grate including a number of plate-formed grate elements according to claim 1.

13. The plate-formed grate element of claim 2, wherein the nominal wall thickness of the outwardly curved front wall varies by less than ±25 percent.

14. The plate-formed grate element of claim 2, wherein the nominal wall thickness of the outwardly curved front wall varies by less than ±20 percent.

15. The plate-formed grate element of claim 3, wherein the first nominal radius of curvature (R) is more than 4 times larger than the second nominal radius of curvature (r).

16. The plate-formed grate element of claim 3, wherein the first nominal radius of curvature (R) is more than 5 times larger than the second nominal radius of curvature (r).

17. The plate-formed grate element of claim 7, wherein the reduced cross-sectional flow area ($A_{reduced}$) is less than 50 percent of the inlet/outlet cross-sectional flow area ($A_{inlet}$, $A_{outlet}$).

18. The plate-formed grate element of claim 7, wherein the reduced cross-sectional flow area ($A_{reduced}$) is less than 40 percent of the inlet/outlet cross-sectional flow area ($A_{inlet}$, $A_{outlet}$).

* * * * *